US009703258B2

(12) United States Patent
Kanada et al.

(10) Patent No.: US 9,703,258 B2
(45) Date of Patent: Jul. 11, 2017

(54) DEVELOPING CARTRIDGE AND PROCESS CARTRIDGE

(71) Applicant: Brother Kogyo Kabushiki Kaisha, Nagoya-shi, Aichi-ken (JP)

(72) Inventors: Soun Kanada, Nagoya (JP); Satoru Ishikawa, Kitanagoya (JP); Hiroya Fukuta, Nagoya (JP); Ryuji Noda, Seto (JP); Takashi Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/333,992

(22) Filed: Jul. 17, 2014

(65) Prior Publication Data

US 2015/0023694 A1 Jan. 22, 2015

(30) Foreign Application Priority Data

Jul. 19, 2013 (JP) ..... 2013-150924

(51) Int. Cl.
*G03G 21/16* (2006.01)
*G03G 21/18* (2006.01)
*G03G 15/08* (2006.01)

(52) U.S. Cl.
CPC ..... *G03G 21/1676* (2013.01); *G03G 15/0812* (2013.01); *G03G 21/1821* (2013.01); *G03G 21/1839* (2013.01)

(58) Field of Classification Search
CPC ..... G03G 21/1676; G03G 21/1839; G03G 21/1821; G03G 15/0812
See application file for complete search history.

(56) References Cited

U.S. PATENT DOCUMENTS 5,404,198 A * 4/1995 Noda et al. ..... 399/107
5,608,509 A * 3/1997 Shirai et al. ..... 399/351
(Continued)

FOREIGN PATENT DOCUMENTS

JP 2007-256351 A 10/2007
JP 2011-175287 A 9/2011

OTHER PUBLICATIONS

The American Heritage College Dictionary, Houghton Mifflin Co., 3d Ed., definition: "aligned" (2000).*
(Continued)

*Primary Examiner* — Sevan A Aydin
(74) *Attorney, Agent, or Firm* — Banner & Witcoff, Ltd.

(57) ABSTRACT

A developing cartridge includes a casing configured to store a developing agent, a developing agent carrying member disposed rotatably in the casing and configured to carry the developing agent, and a layer-thickness regulating member configured to regulate a thickness of a layer of the developing agent. The casing includes an attachment portion to which the layer-thickness regulating member is attached, a receiving portion configured to receive pressing force for pressing the developing agent carrying member toward an image carrying member in a direction perpendicular to an axial direction of the developing agent carrying member, and a wall portion disposed between the attachment portion and the receiving portion. The receiving portion is disposed to overlap with at least a portion of the attachment portion when viewed from a direction perpendicular to the axial direction of the developing agent carrying member.

17 Claims, 18 Drawing Sheets

(56) References Cited

U.S. PATENT DOCUMENTS

| | | | | |
|---|---|---|---|---|
| 5,623,328 | A * | 4/1997 | Tsuda et al. | 399/111 |
| 5,907,749 | A * | 5/1999 | Nomura et al. | 399/113 |
| 5,987,278 | A * | 11/1999 | Nomura et al. | 399/109 |
| 6,009,289 | A * | 12/1999 | Sekine et al. | 399/113 |
| 6,118,961 | A * | 9/2000 | Nomura et al. | 399/113 |
| 6,442,359 | B1 * | 8/2002 | Numagami et al. | 399/111 |
| 7,373,096 | B1 * | 5/2008 | Miller | 399/114 |
| 7,561,827 | B2 | 7/2009 | Shiraki et al. | |
| 2002/0028088 | A1 * | 3/2002 | Okabe et al. | 399/113 |
| 2002/0110386 | A1 * | 8/2002 | Kanno et al. | 399/111 |
| 2004/0184835 | A1 * | 9/2004 | Park | 399/116 |
| 2005/0025522 | A1 * | 2/2005 | Tsuzuki et al. | 399/111 |
| 2007/0217818 | A1 | 9/2007 | Shiraki et al. | |
| 2008/0199214 | A1 * | 8/2008 | Mori G03G 21/1821 | 399/119 |
| 2009/0162095 | A1 * | 6/2009 | Yoshimura et al. | 399/114 |
| 2009/0169246 | A1 * | 7/2009 | Ooyoshi et al. | 399/111 |
| 2011/0262183 | A1 * | 10/2011 | Seto et al. | 399/117 |
| 2011/0311270 | A1 * | 12/2011 | Takagi et al. | 399/111 |
| 2012/0207510 | A1 * | 8/2012 | Sato | 399/110 |
| 2013/0064568 | A1 * | 3/2013 | Fujiwara et al. | 399/90 |
| 2013/0084106 | A1 * | 4/2013 | Tsuda et al. | 399/258 |
| 2013/0108318 | A1 * | 5/2013 | Maeshima et al. | 399/111 |
| 2013/0164030 | A1 * | 6/2013 | Anan et al. | 399/111 |
| 2013/0216264 | A1 * | 8/2013 | Shimizu et al. | 399/167 |

OTHER PUBLICATIONS

Dec. 6, 2016—(JP) Notice of Reasons for Rejection—App 2013-150924.

* cited by examiner

DEVELOPING CARTRIDGE AND PROCESS CARTRIDGE

CROSS-REFERENCE TO RELATED APPLICATION

This application claims priority from Japanese Patent Application No. 2013-150924 filed on Jul. 19, 2013, the content of which is incorporated herein by reference in its entirety.

FIELD OF DISCLOSURE

The disclosure relates to a developing cartridge and a process cartridge configured to be mounted or installed in an electrophotographic image forming apparatus.

BACKGROUND

A known electrophotographic image forming apparatus includes an image carrying member configured to carry an electrostatic latent image and a developing agent carrying member configured to carry a developing agent and supply the developing agent to an electrostatic latent image on the image carrying member.

For example, a known laser printer includes a frame holding a photosensitive drum and a developing unit supporting a developing roller. The developing unit is configured to be attached to and removed from the frame.

In the laser printer, protrusions protrude outward in an axial direction of the developing roller from a storage case of the developing unit. As the protrusions are pressed, the developing unit is pressed toward the photosensitive drum.

SUMMARY

For example, when the protrusions are deformed, the developing unit may be uniformly pressed in the axial direction of the developing roller toward the photosensitive drum.

In this case, a layer-thickness regulating blade, which is included in the developing unit and configured to regulate the thickness of a toner layer on the developing roller, may possibly warp or distort in the axial direction. As the layer-thickness regulating blade warps or distorts, the thickness of the toner layer on the developing roller may become inconsistent in the axial direction, and the density of an image may be inconsistent in the axial direction.

The disclosure relates to a developing cartridge and a process cartridge in which warp or distortion of a layer-thickness regulating member of the developing cartridge, as well as a body of the developing cartridge, is reduced.

According to one or more aspects of the disclosure, a developing cartridge may include a casing configured to store a developing agent, a developing agent carrying member disposed rotatably in the casing and configured to carry the developing agent in the casing, and a layer-thickness regulating member disposed in the casing and configured to regulate a thickness of a layer of the developing agent carried on the developing agent carrying member. The casing may include an attachment portion to which the layer-thickness regulating member is attached, a receiving portion configured to receive pressing force for pressing the developing agent carrying member toward an image carrying member in a direction perpendicular to an axial direction of the developing agent carrying member, and a wall portion disposed between the attachment portion and the receiving portion. The receiving portion may be disposed to overlap with at least a portion of the attachment portion when viewed from a direction perpendicular to the axial direction of the developing agent carrying member.

According to one or more other aspects of the disclosure, a process cartridge may include a developing cartridge and an image carrying member cartridge. A developing cartridge may include a casing configured to store a developing agent, a developing agent carrying member disposed rotatably in the casing and configured to carry the developing agent in the casing, and a layer-thickness regulating member disposed in the casing and configured to regulate a thickness of a layer of the developing agent carried on the developing agent carrying member. The casing may include an attachment portion to which the layer-thickness regulating member is attached, a receiving portion configured to receive pressing force for pressing the developing agent carrying member toward an image carrying member in a direction perpendicular to an axial direction of the developing agent carrying member, and a wall portion disposed between the attachment portion and the receiving portion. The receiving portion may be disposed to overlap with at least a portion of the attachment portion when viewed from a direction perpendicular to the axial direction of the developing agent carrying member. The image carrying member cartridge may include an image carrying member configured to carry a developing agent image, a frame configured to support the image carrying member and to receive the developing cartridge, and a pressing member configured to be slideably supported in a direction perpendicular to the axial direction by the frame and to press the receiving portion.

According to one or more other aspects of the disclosure, a process cartridge may include a developing cartridge and an image carrying member cartridge. The developing cartridge may include a casing configured to store a developing agent, and a developing agent carrying member disposed rotatably in the casing and configured to carry the developing agent in the casing. The image carrying member cartridge may include an image carrying member configured to carry a developing agent image, a frame configured to support the image carrying member and to receive the developing cartridge, and a pressing member configured to be slideably supported in a direction perpendicular to the axial direction by the frame and to press the receiving portion. The casing may include a receiving portion configured to receive pressing force for pressing the developing agent carrying member toward an image carrying member in a direction perpendicular to an axial direction of the developing agent carrying member, and a wall portion extending in a direction perpendicular to the axial direction. The receiving portion may be disposed to overlap with at least a portion of the wall portion when viewed from a direction perpendicular to the axial direction.

DETAILED DESCRIPTION

1. Outline of Developing Cartridge

Figure 1:
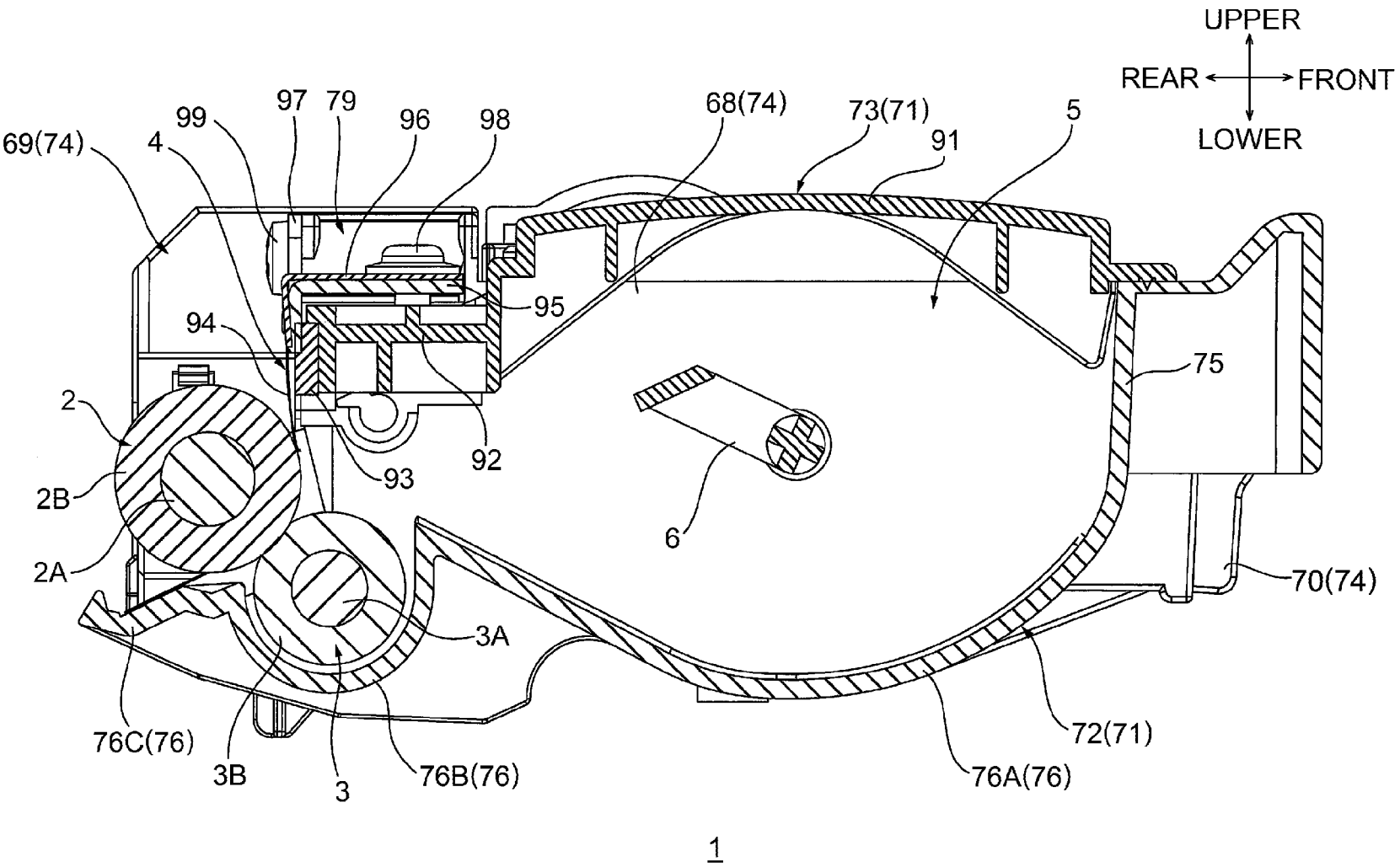
FIG. 1 is a side sectional view of a developing cartridge in an illustrative embodiment according to one or more aspects of the disclosure.

As depicted in FIG. 1, a developing cartridge 1 includes a developing agent carrying member, e.g., a developing roller 2, a supply roller 3, a layer-thickness regulating member, e.g., a layer-thickness regulating blade 4, and a developing frame 71 including a toner chamber 5.

In the following description, a top-bottom direction, e.g., a vertical direction, of the developing cartridge 1 is defined in conjunction with an orientation in which the developing cartridge 1 is placed in a horizontal plane. More specifically, the top or upper side and the bottom or lower side in the sheet of FIG. 1 is defined as the top or upper side and the bottom or lower side of the developing cartridge 1, respectively. The right side and left side in the sheet of FIG. 1 is defined as the front side and rear side of the developing cartridge 1, respectively. The left-right direction of the developing cartridge 1 is determined when the developing cartridge 1 is viewed from the front side. More specifically, the front or near side and the back side of the sheet of FIG. 1 is defined as the left side and the right side of the developing cartridge 1, respectively. The left-right direction is an example of an axial direction. The front-rear direction is an example of a direction perpendicular to the axial direction. A direction from the upper side toward the lower side is an example of a mounting direction. A direction from the front side toward the rear side is an example of a pressing direction.

The developing roller 2 is rotatably supported in a rear end portion of the developing cartridge 1. The developing roller 2 includes a developing roller shaft 2A and a developing roller body 2B.

The developing roller shaft 2A has a generally cylindrical shape. The developing roller shaft 2A extends along the left-right direction. The developing roller shaft 2A includes metal. Each end portion of the developing roller shaft 2A in the left-right direction is inserted into a developing roller shaft insertion opening 77 of the developing frame 71 (described below).

The developing roller body 2B has a generally tubular shape. The developing roller body 2B extends along the left-right direction. The developing roller body 2B includes rubber having conductivity. The developing roller body 2B covers a generally central portion of the developing roller shaft 2A in the left-right direction, without covering each left and right end portion of the developing roller shaft 2A.

The supply roller 3 is disposed at a lower front portion of the developing roller 2. The supply roller 3 is rotatably supported in the developing cartridge 1. The supply roller 3 includes a supply roller shaft 3A and a supply roller body 3B.

The supply roller shaft 3A has a generally cylindrical shape. The supply roller shaft 3A extends along the left-right direction. The supply roller shaft 3A includes metal. Each end portion of the supply roller shaft 3A in the left-right direction is inserted into a supply roller shaft insertion opening 78 of the developing frame 71 (described below).

The supply roller body 3B has a generally tubular shape. The supply roller body 3B extends along the left-right direction. The supply roller body 3B includes sponge having conductivity. The supply roller body 3B covers a generally central portion of the supply roller shaft 3A in the left-right direction, without covering each left and right end portion of the supply roller shaft 3A. The supply roller body 3B contacts a lower front end portion of the developing roller body 2B.

The layer-thickness regulating blade 4 is disposed at an upper front portion of the developing roller 2. The layer-thickness regulating blade 4 contacts a front end portion of the developing roller 2.

The toner chamber 5 is disposed in front of the supply roller 3 and the layer-thickness regulating blade 4. The toner chamber 5 is configured to store developing agent, e.g., toner. The toner chamber 5 includes an agitator 6.

The agitator 6 is rotatably supported in the toner chamber 5.

2. Usage of Developing Cartridge

Figure 2:
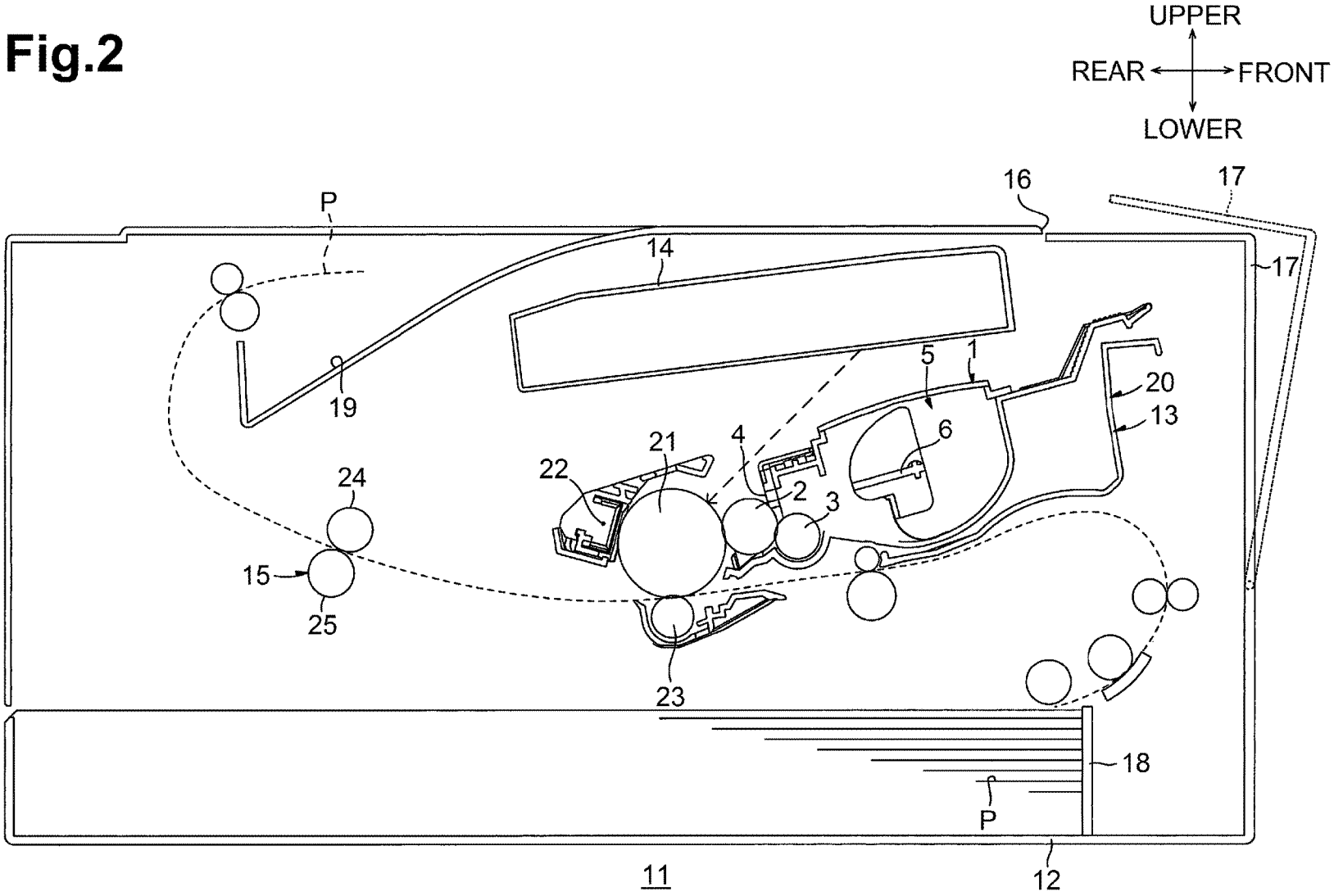
FIG. 2 is a side sectional view of an image forming apparatus to which the developing cartridge depicted in FIG. 1 is to be mounted.

As depicted in FIG. 2, the developing cartridge 1 is used by mounting the developing cartridge 1 to an image forming apparatus 11.

The image forming apparatus 11 is, for example, an electrophotographic monochrome printer. The image forming apparatus 11 includes a main casing 12, a process cartridge 13, a scanner unit 14, and a fixing unit 15.

The main casing 12 has a generally box shape. The main casing 12 includes an opening portion 16, a front cover 17, a sheet supply tray 18, and a sheet discharge tray 19.

The opening portion 16 is disposed at a front end portion of the main casing 12. The opening portion 16 is provided to allow an interior and an exterior of the main casing 12 to communicate with each other in the front-rear direction. The opening portion 16 permits the process cartridge 13 to pass therethrough.

The front cover 17 is disposed at a front end portion of the main casing 12. The front cover 17 has a generally flat plate shape. The front cover 17 extends along the top-bottom direction. The front cover 17 may be pivotally supported about a lower end portion thereof by a front wall of the main casing 12. The front cover 17 may be configured to open or close the opening portion 16.

The sheet supply tray 18 is disposed at a bottom portion of the main casing 12. The sheet supply tray 18 may be configured to accommodate one or more sheets P.

The sheet discharge tray 19 is disposed on an upper wall of the main casing 12. The sheet discharge tray 19 is depressed downward from an upper surface of the main casing 12 to receive the sheets P.

The process cartridge 13 is accommodated in a generally central portion of the main casing 12 in the top-bottom direction. The process cartridge 13 is configured to be attached to or removed from the main casing 12. The process cartridge 13 includes an image carrying member cartridge, e.g., a drum cartridge 20, and the developing cartridge 1.

The drum cartridge 20 includes a photosensitive drum 21, a scorotron charger 22, and a transfer roller 23. The drum cartridge is an example of an image carrying member.

The photosensitive drum 21 is rotatably supported at a rear end portion of the drum cartridge 20.

The scorotron charger 22 is disposed behind the photosensitive drum 21 with a distance between the scorotron charger 22 and the photosensitive drum 21.

The transfer roller 23 is disposed below the photosensitive drum 21. The transfer roller 23 contacts a lower end portion of the photosensitive drum 21.

The developing cartridge 1 is configured to be attached to the drum cartridge 20 in front of the photosensitive drum 21, such that the developing roller 2 contacts a lower front end portion of the photosensitive drum 21.

The scanner unit 14 is disposed above the process cartridge 13. The scanner unit 14 is configured to emit laser beam toward the photosensitive drum 21 based on image data.

The fixing unit 15 is disposed behind the process cartridge 13. The fixing unit 15 includes a heat roller 24 and a pressure roller 25 pressed against a lower rear end portion of the heat roller 24.

When the image forming apparatus 11 starts an image forming operation, the scorotron charger 22 uniformly changes a surface of the photosensitive drum 21. The scanner unit 14 exposes the surface of the photosensitive drum 21 with light. Thus, an electrostatic latent image based on image data is formed on the surface of the photosensitive drum 21.

The agitator 6 agitates the toner in the toner chamber 5, and supplies the toner to the supply roller 3. The supply roller 3 supplies the toner supplied by the agitator 6 to the developing roller 2. At this time, the toner is positively charged between the developing roller 2 and the supply roller 3 by friction, and is carried on the developing roller 2. The layer-thickness regulating blade 4 regulates the thickness of the toner layer carried on the developing roller 2 to a constant thickness.

Then, the toner carried on the developing roller 2 is supplied to the electrostatic latent image on the surface of the photosensitive drum 21. Thus, a toner image is carried on the surface of the photosensitive drum 21.

The sheets P is supplied one by one between the photosensitive drum 21 and the transfer roller 23 from the sheet supply tray 18 at a predetermined timing, with the rotation of various rollers. The toner image on the surface of the photosensitive drum 21 is transferred to the sheet P when the sheet P passes between the photosensitive drum 21 and the transfer roller 23.

Thereafter, when the sheet P passes between the heat roller 24 and the pressure roller 25, heat and pressure are applied to the sheet P. Thus, the toner image on the sheet P is thermally fixed on the sheet P. Thereafter, the sheet P is discharged onto the sheet discharge tray 19.

3. Details of Developing Cartridge (1) Structure of Drum Cartridge

Figure 3:
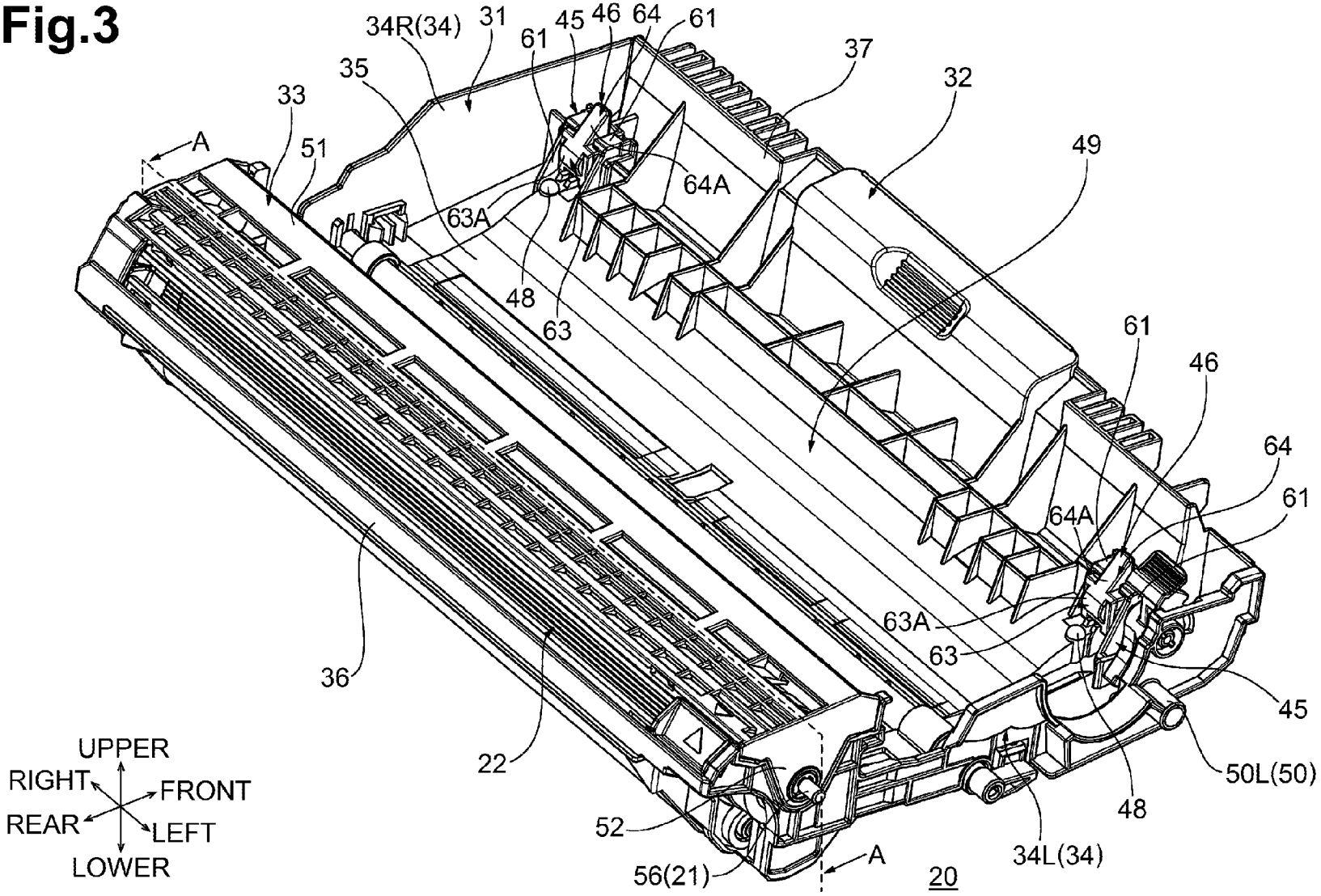
FIG. 3 is a perspective view of a drum cartridge viewed from an upper rear side thereof.

As depicted in FIGS. 2 and 3, the drum cartridge 20 includes a frame, e.g., a drum frame 31, the photosensitive drum 21, the scorotron charger 22, and the transfer roller 23.

(1-1) Drum Frame

Figure 4:
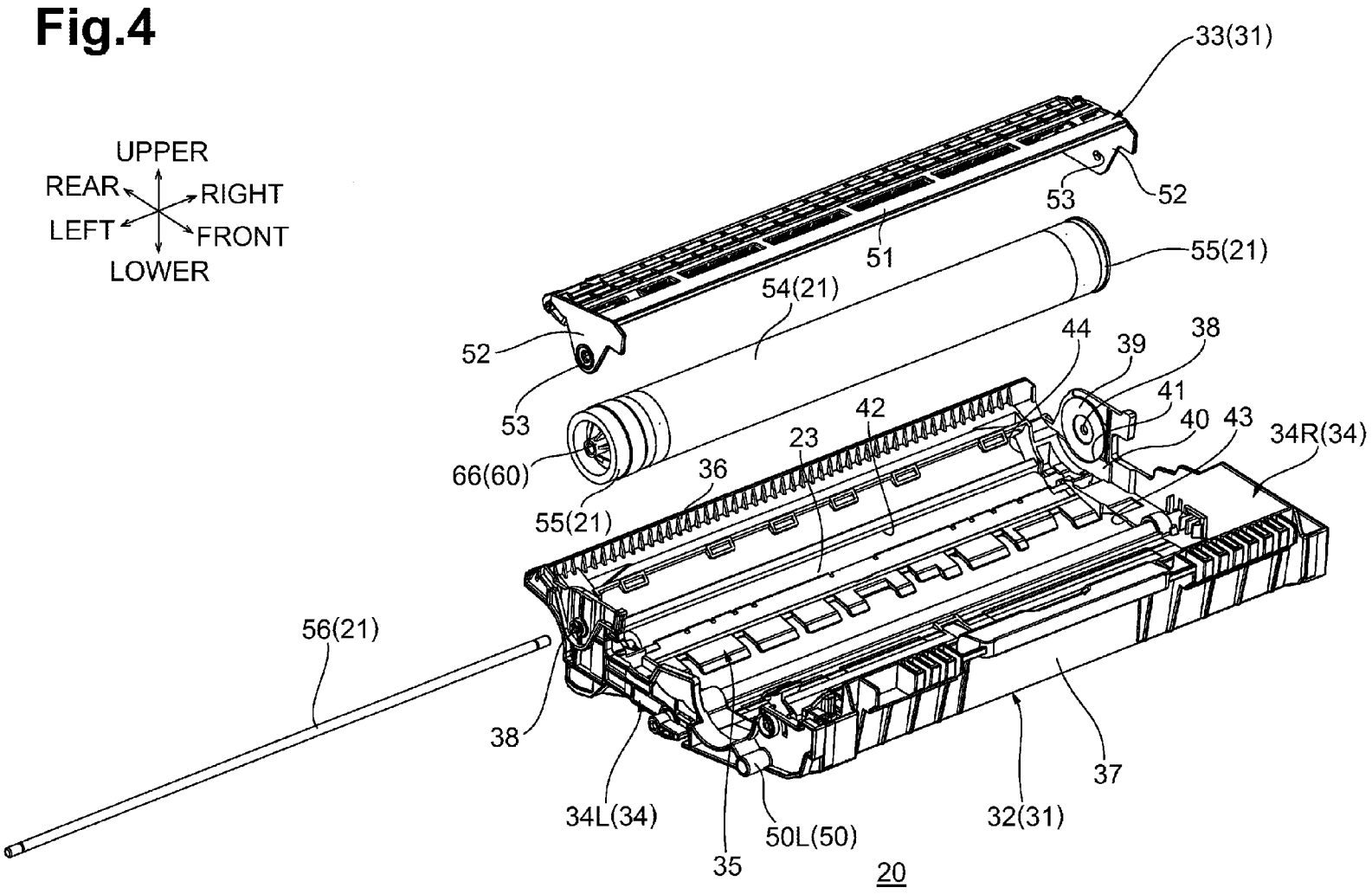
FIG. 4 is an exploded perspective view the drum cartridge depicted in FIG. 3 viewed from an upper front side thereof.

As depicted in FIGS. 3 and 4, the drum frame 31 includes a base frame 32 and a cover frame 33.

The base frame 32 has a generally rectangular shape in plan view. The base frame 32 has a bottomed frame shape. The base frame 32 is integrally provided with a pair of side walls 34, a bottom wall 35, a rear wall 36, and a front wall 37.

Each side wall 34 is disposed at each end portion of the base frame 32 in the left-right direction. In the following description, the left side wall 34 is denoted as the left side wall 34L and the right side wall 34 is denoted as the right side wall 34R. Each side wall 34 has a generally rectangular flat plate shape in side view. Each side wall 34 extends along the front-rear direction. Each side wall 34 includes a drum shaft insertion opening 38 and a positioning portion, e.g., a positioning boss 50. The right side wall 34R includes a drum receiving portion 40 and a friction pad 39.

The drum shaft insertion opening 38 is disposed at a generally central portion of a rear end portion of the side wall 34 in the top-bottom direction. The drum shaft insertion opening 38 has a generally circular shape in sectional view. The drum shaft insertion opening 38 extends through the side wall 34 in the left-right direction. The inside diameter of the drum shaft insertion opening 38 is slightly greater than the outside diameter of a drum shaft 56 of the photosensitive drum 21. The drum shaft insertion openings 38 in the respective side walls 34 correspond to each other when projected in the left-right direction.

Figure 10A:
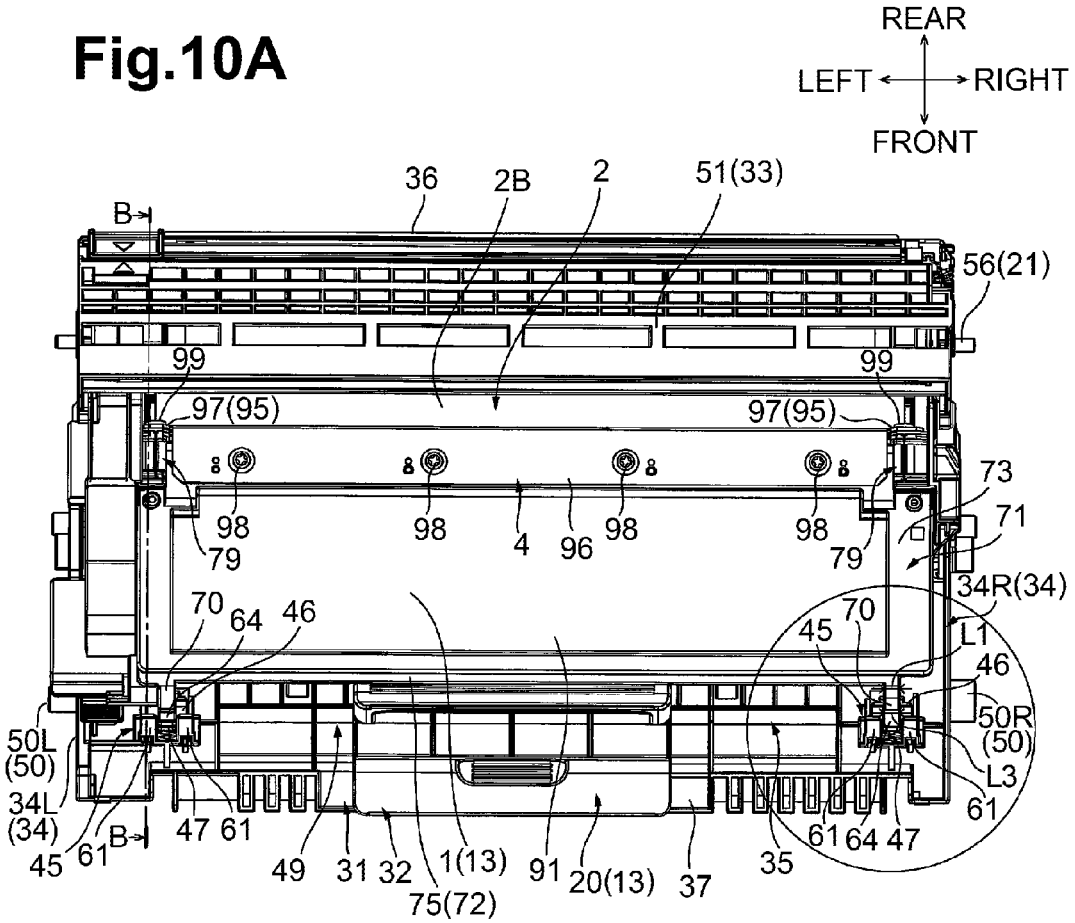
FIG. 10A is a plan view of a process cartridge.
Figure 10B:
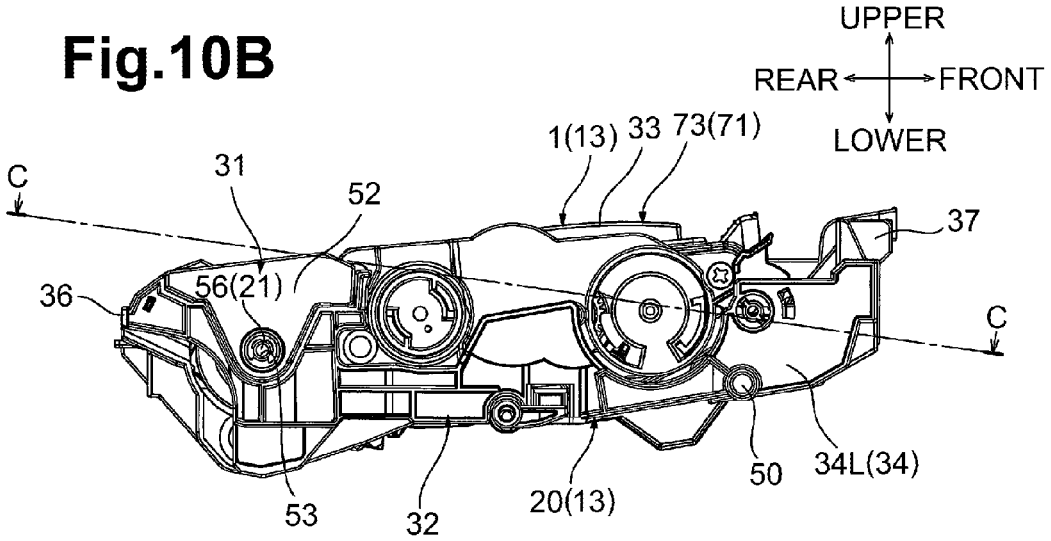
FIG. 10B is a left side view of the process cartridge.

The positioning boss 50 is disposed at a front lower end portion of the side wall 34. The positioning boss 50 has a generally tubular shape. The left positioning boss 50L protrudes leftward from the left surface of the left side wall 34L. As depicted in FIG. 10A, the right positioning boss 50R protrudes rightward from the right surface of the right side wall 34R. The positioning bosses 50 are fixed in position in the main casing 12, when the process cartridge 13 is mounted to the main casing 12.

The drum receiving portion 40 is disposed below the drum shaft insertion opening 38. The drum receiving portion 40 has a generally rectangular shape in side view. The drum receiving portion 40 extends slightly inwardly in the left-right direction from the inner surface of the right side wall 34R. The drum receiving portion 40 includes a recess portion 41.

The recess portion 41 is disposed at a generally central portion of an upper edge of the drum receiving portion 40 in the front-rear direction. The recess portion 41 is depressed downward. The recess portion 41 has a shape of a generally arc whose center is the drum shaft insertion opening 38. The recess portion 41 is configured to extend along the peripheral surface of a friction member 58 (described below) of the photosensitive drum 21.

The friction pad 39 is disposed above the drum receiving portion 40. The friction pad 39 has a generally an annular shape. The outside diameter of the friction pad 39 is greater than the outside diameter of a friction member 58 (described below) of the photosensitive drum 21. The inside diameter of the friction pad 39 is greater than the outside diameter of the drum shaft insertion opening 38. The friction pad 39 includes nonwoven fabric. The friction pad 39 is attached to the inner surface of the right side wall 34R to surround the drum shaft insertion opening 38.

The bottom wall 35 extends along the front-rear direction between lower end portions of the side walls 34. The bottom wall 35 has a generally rectangular flat plate shape in plan view. The bottom wall 35 includes a transfer roller supporting portion 42, a supply opening 43, a discharge opening 44, two pressing member supporting portions 45, two pressing members 46, and a second contact portion, e.g., two contact protrusions 48.

The transfer roller supporting portion 42 is disposed at a rear end portion of the bottom wall 35. The transfer roller supporting portion 42 is depressed downward from the upper surface of the bottom wall 35 and extends along the left-right direction.

The supply opening 43 is disposed at a generally central portion of the bottom wall 35 in the front-rear direction, in front of the transfer roller supporting portion 42. The supply opening 43 has a generally rectangular shape in plan view. The supply opening 43 extends through the bottom wall 35 in the top-bottom direction and extends along the left-right direction. The supply opening 43 permits the sheet P to be supplied between the photosensitive drum 21 and the transfer roller 23, as depicted in FIG. 2, to pass therethrough.

The discharge opening 44 is disposed at a rear end portion of the bottom wall 35 behind the transfer roller supporting portion 42. The discharge opening 44 has a generally rectangular shape in plan view. The discharge opening 44 extends through the bottom wall 35 in the top-bottom direction and extends along the left-right direction. As depicted in FIG. 2, the discharge opening 44 permits the sheet P to pass therethrough from a portion between the photosensitive drum 21 and the transfer roller 23 to the fixing unit 15, as depicted in FIG. 2.

Figure 12A:
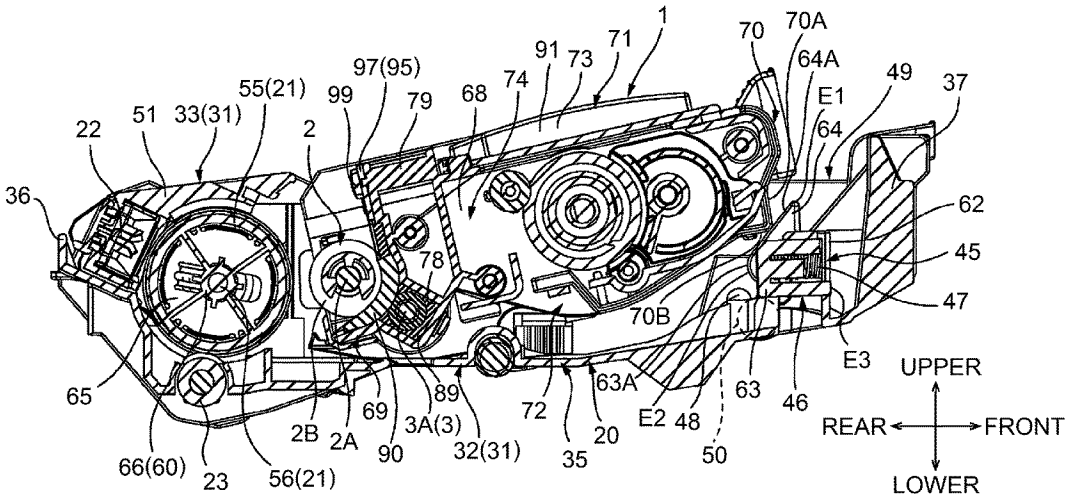
FIG. 12A is a side sectional view of the process cartridge depicted in FIG. 10A, taken along a line B-B in FIG. 10A, illustrating a process of inserting the developing cartridge into the drum cartridge, in which the developing cartridge is started to be inserted into the drum cartridge.
Figure 12B:
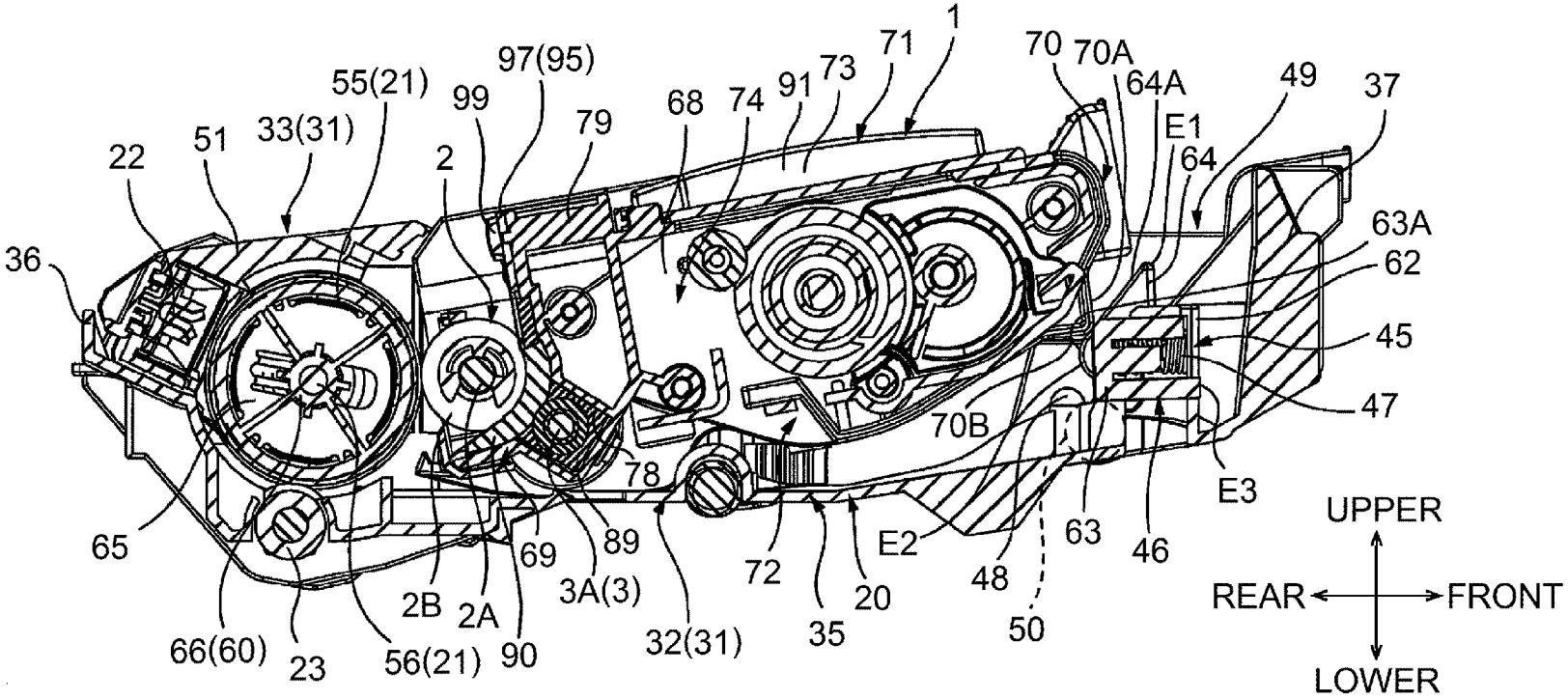
FIG. 12B is a side sectional view of the process cartridge depicted in FIG. 10A, taken along the line B-B in FIG. 10A, illustrating a process of inserting the developing cartridge into the drum cartridge following FIG. 12A, in which a developing roller contacts the photosensitive drum.
Figure 12C:
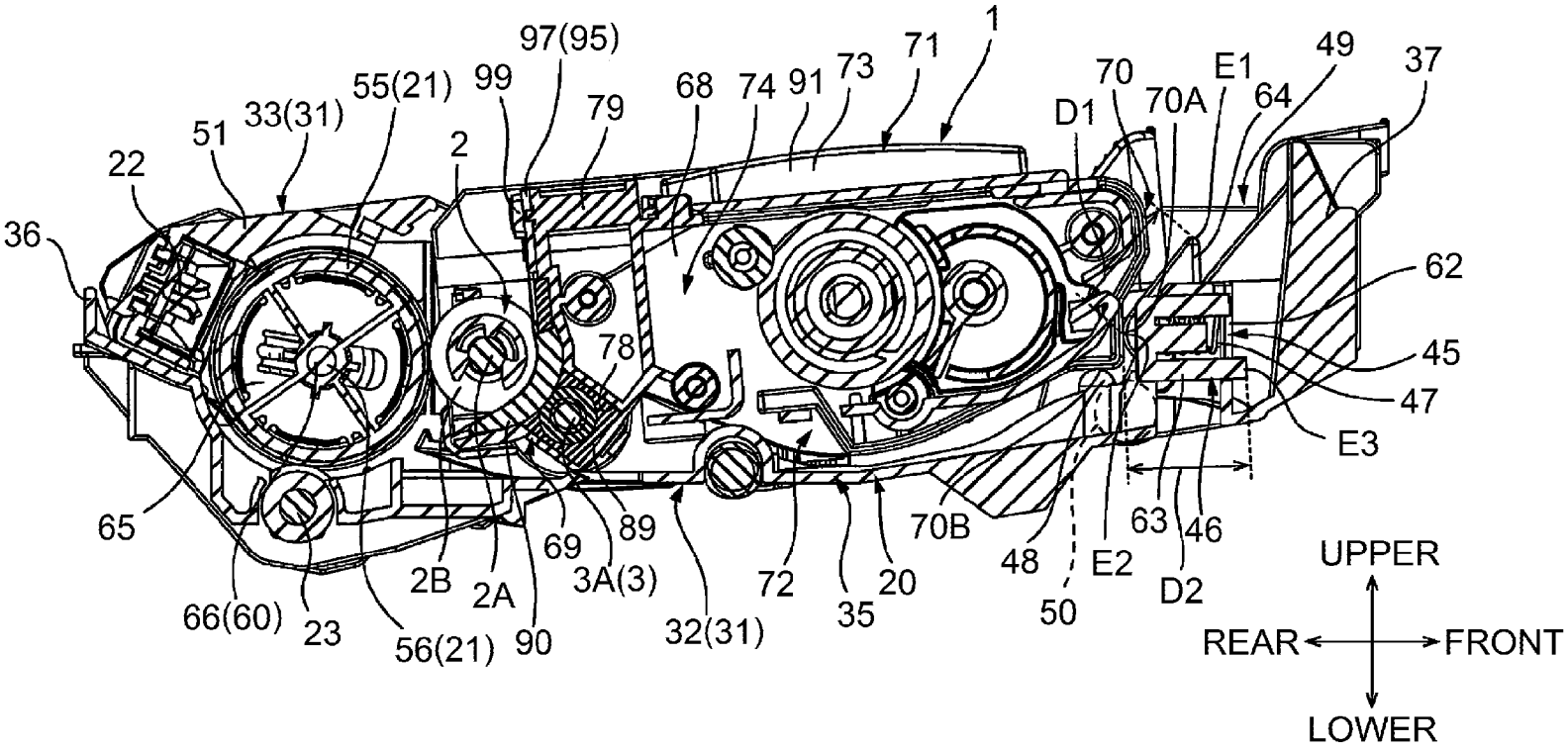
FIG. 12C is a side sectional view of the process cartridge depicted in FIG. 10A, taken along the line B-B in FIG. 10A, illustrating a process of inserting the developing cartridge into the drum cartridge following FIG. 12B, in which the developing cartridge has been mounted to the drum cartridge.

Each pressing member supporting portion 45 is disposed at left and right end portions of the bottom wall 35, as depicted in FIGS. 3 and 12C. Each pressing member supporting portion 45 includes a pair of side plates 61 and a front plate 62.

Each side plate 61 is disposed with a distance therebetween in the left-right direction. Each side plate 61 protrudes upward from the upper surface of the bottom wall 35 and bends inwardly in the left-right direction at an upper end portion thereof.

The front plate 62 is disposed in front of the side plates 61, e.g., at front end portions of the side plates 61 between the side plates 61. The front plate 62 protrudes upwardly from the upper surface of the bottom wall 35.

Each pressing member 46 is slideably disposed along the front-rear direction between the side plates 61 of each pressing member supporting portion 45. Each pressing member 46 includes a pressing portion 63 and a protruding portion 64.

The pressing portion 63 has a generally prism shape. The pressing portion 63 extends along the front-rear direction. A rear end portion of the pressing portion 63 is closed. A rear face 63A of the pressing portion 63 has a generally arc shape in side view. The pressing portion 63 includes a compression spring 47.

The compression spring 47 is disposed in an interior of the pressing portion 63. The compression spring 47 includes a coil spring extending along the front-rear direction. A front end portion of the compression spring 47 contacts the front plate 62 of the pressing member supporting portion 45. A rear end portion of the compression spring 47 contacts a rear wall of the pressing portion 63. The compression spring 47 urges the pressing member 46 rearward.

The protruding portion 64 is disposed above the pressing portion 63. The protruding portion 64 has a generally triangular flat plate shape in side view. A portion of the protruding portion 64 protrudes upward above upper end portions of the side plates 61 from a generally central portion of the pressing portion 63 in the left-right direction, through a portion between the upper end portions of the side plates 61. A rear face 64A of the protruding portion 64 connects or continues to an upper end portion of the rear face 63A of the pressing portion 63. As the rear face 64A extends more upwardly, the rear face 64 inclines more forwardly. The rear face 64A of the protruding portion 64 is an example of an inclined surface. A distance D1 between an upper end E1 of the protruding portion 64 and a rear end E2 of the pressing portion 63 is shorter than a distance D2 between the rear end E2 of the pressing portion 63 and a front end E3 of the pressing portion 63.

Each contact protrusion 48 is disposed behind the respective pressing member supporting portion 45. Each contact protrusion 48 has a generally hemispherical shape. Each contact protrusion 48 extends upward from the upper surface of the bottom wall 35. Each contact protrusion 48 overlaps with a rear end portion of the positioning boss 50 when projected in the left-right direction.

The rear wall 36 protrudes upward from the bottom wall 35 behind the discharge opening 44 and extends along the left-right direction. The rear wall 36 has a generally rectangular flat plate shape in front view.

The front wall 37 extends upward continuously from a front end portion of the bottom wall 35. The front wall 37 has a generally rectangular flat plate shape in front view. Each left and right end portion of the front wall 37 continues to front end portions of the side walls 34.

As depicted in FIGS. 3 and 4, the cover frame 33 is disposed above a rear end portion of the base frame 32. The cover frame 33 is integrally provided with an upper wall 51 and a pair of engagement portions 52.

The upper wall 51 has a generally rectangular flat plate shape in plan view. The upper wall 51 extends along the left-right direction.

Each engagement portion 52 extends downward from each end portion of the upper wall 51 in the left-right direction. Each engagement portion 52 has a generally flat plate shape. Each engagement portion 52 has a drum shaft insertion opening 53.

The drum shaft insertion opening 53 is disposed at a lower end portion of the engagement portion 52. The drum shaft insertion opening 53 has a generally circular shape in side view. The drum shaft insertion opening 53 extends through the engagement portion 52 in the left-right direction. The inside diameter of the drum shaft insertion opening 53 is slightly greater than the outside diameter of the drum shaft 56 of the photosensitive drum 21.

(3) Photosensitive Drum, Transfer Roller and Scorotron Charger

Figure 5:
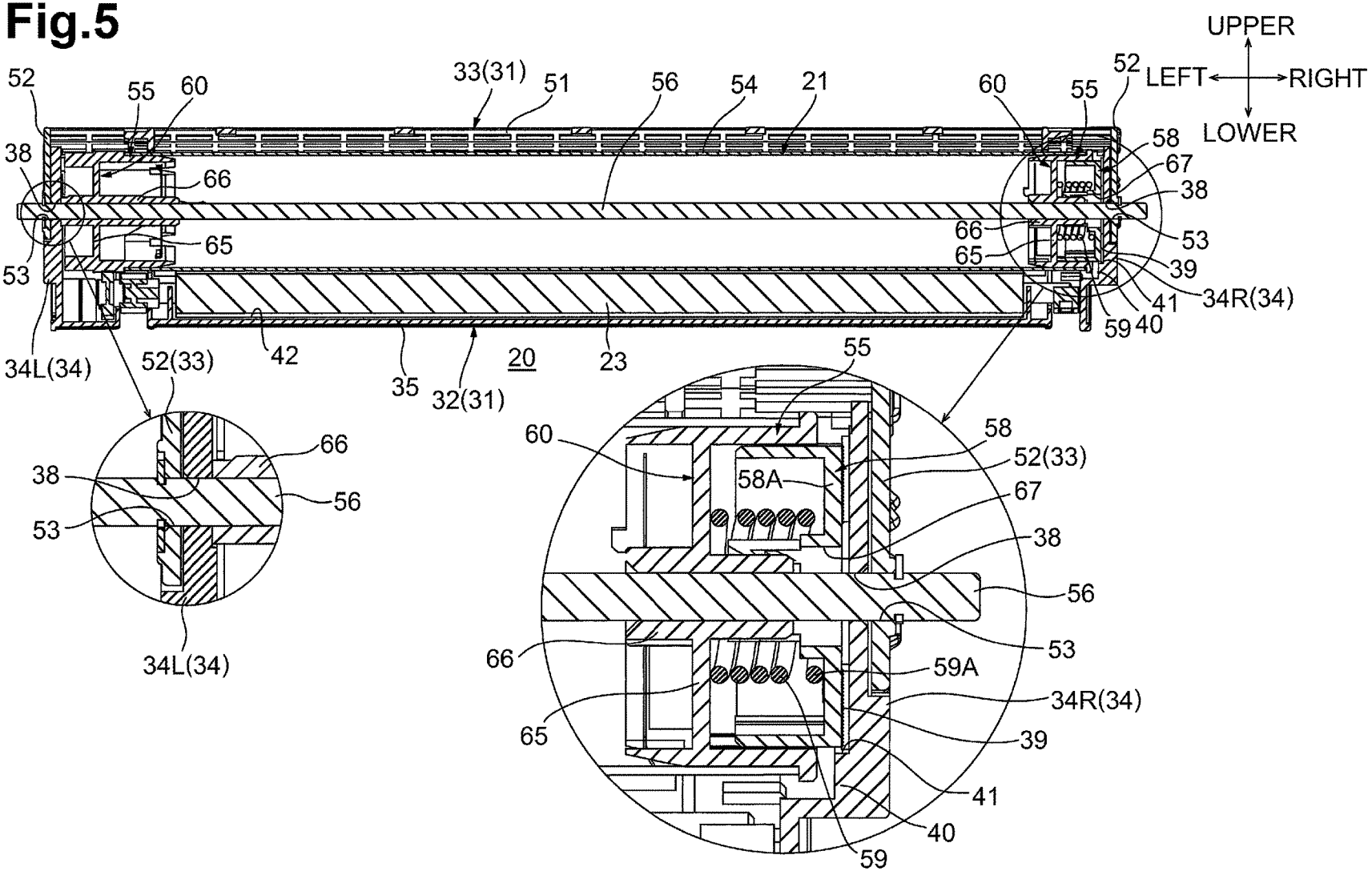
FIG. 5 is a sectional view of the drum cartridge depicted in FIG. 3, taken along a line A-A in FIG. 3.

As depicted in FIGS. 4 and 5, the photosensitive drum 21 includes a drum body 54, two flange members 55, a friction member 58, a compression spring 59, and a drum shaft 56.

The drum body 54 has a generally tubular shape. The drum body 54 extends along the left-right direction.

Each flange member 55 is attached to each end portion of the drum body 54 in the left-right direction, so as not to rotate relative to the drum body 54. Each flange member 55 has a generally tubular shape. Each flange member 55 extends along the left-right direction. Each flange member 55 includes a drum shaft supporting portion 60.

The drum shaft supporting portion 60 is disposed at a portion of the flange member 55 in the left-right direction. The drum shaft supporting portion 60 includes a flat plate portion 65 and a tubular portion 66.

The flat plate portion 65 extends inwardly in a radial direction thereof from the inner surface of the flange member 55. The flat plate portion 65 has a generally disc shape.

The tubular portion 66 is disposed at a central portion of the flat plate portion 65 in its radial direction. The tubular portion 66 has a generally circular shape in side view. The tubular portion 66 extends through, in the left-right direction, a central portion of the flat plate portion 65 in its radial direction. The inside diameter of the tubular portion 66 is slightly greater than the outside diameter of the drum shaft 56 of the photosensitive drum 21. The left end of the left tubular portion 66 contacts the inner surface of the left side wall 34L of the drum frame 31.

The friction member 58 is disposed in a right end portion of the right flange member 55 so as to slide along the left-right direction. The friction member 58 has a generally tubular shape. A right end portion of the friction member 58 is closed. The outside diameter of the friction member 58 is slightly smaller than the inside diameter of the right flange member 55. The friction member 58 includes a drum shaft insertion opening 67.

The drum shaft insertion opening 67 is disposed at a central portion of the friction member 58 in its radial direction. The drum shaft insertion opening 67 extends through the right wall of the friction member 58 in the left-right direction. The inside dimension of the drum shaft insertion opening 67 is greater than the outside diameter of the drum shaft 56 of the photosensitive drum 21.

The compression spring 59 is disposed between the flat plate portion 65 of the right flange member 55 and the right wall 58A of the friction member 58. The compression spring 59 includes a coil spring extending along the left-right direction. A left end portion of the compression spring 59 contacts the flat plate portion 65 of the right flange member 55. A right end portion 59A of the compression spring 59 contacts the right wall 58A of the friction member 58. The compression spring 59 urges the friction member 58 rightward.

The drum shaft 56 is disposed along a central portion of the photosensitive drum 21 in its radial direction. The drum shaft 56 has a generally cylindrical shape. The drum shaft 56 extends along the left-right direction. The drum shaft 56 includes metal. The drum shaft 56 is rotatably inserted into the drum shaft insertion openings 38 of the base frame 32, the drum shaft insertion openings 53 of the cover frame 33, the tubular portions 66 of the flange members 55, and the drum shaft insertion opening 67 of the friction member 58.

The transfer roller 23 is rotatably supported in the transfer roller supporting portion 42. An upper end portion of the transfer roller 23 extends upward from the transfer roller supporting portion 42.

The scorotron charger 22 is supported by the upper wall 51.

In the drum cartridge 20, a developing cartridge mount portion 49 is defined in front of the photosensitive drum 21 by the photosensitive drum 21, the side walls 34 and the front wall 37. The developing cartridge 1 is configured to be mounted to developing cartridge mount portion 49.

(4) Attachment of Photosensitive Drum to Base Frame

For the assembly of the drum cartridge 20, an operator attaches the transfer roller 23 to the base frame 32, as depicted in FIG. 4. Thereafter, the operator attaches the photosensitive drum 21 to the base frame 32.

Figure 6:
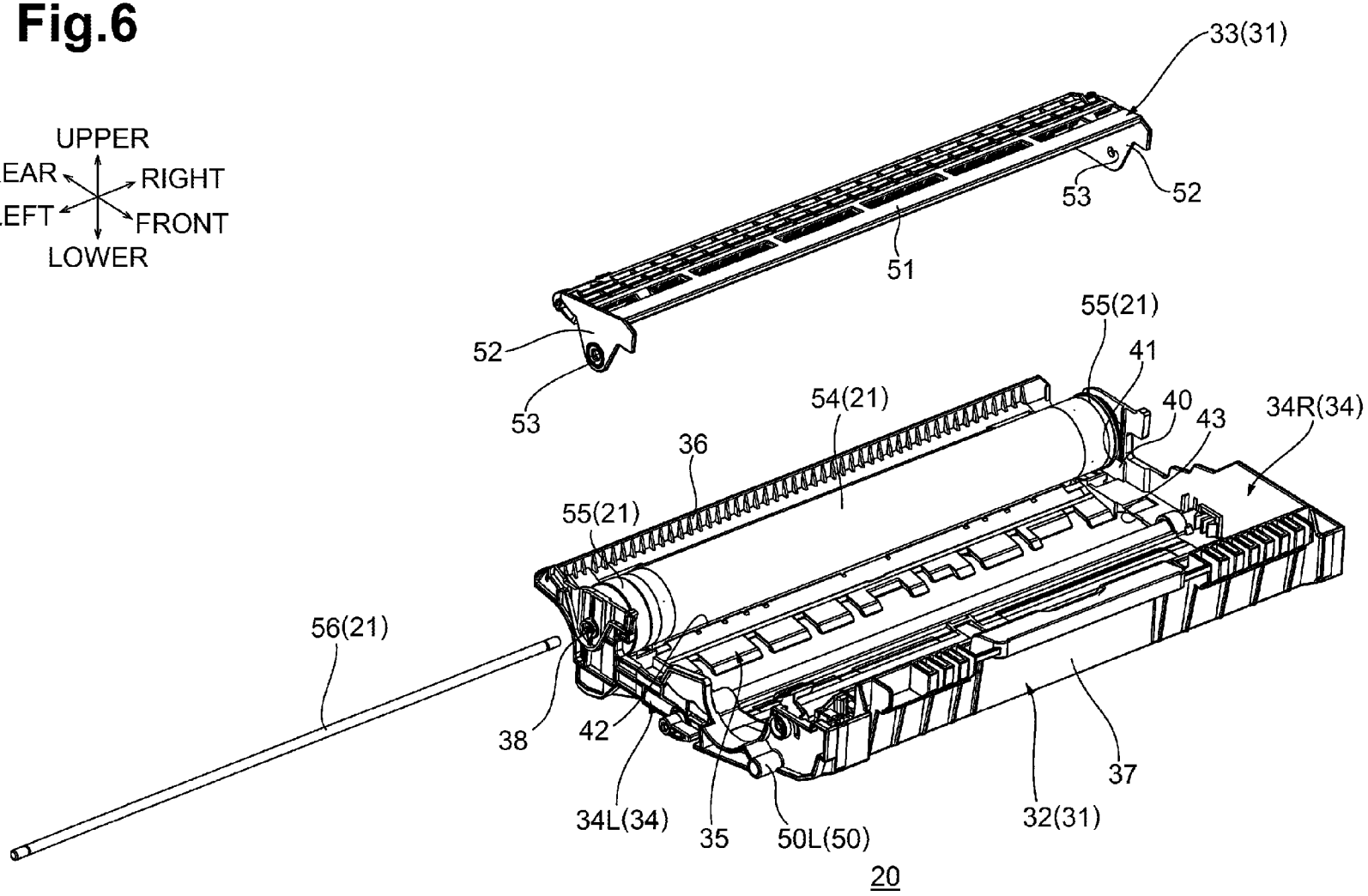
FIG. 6 is a perspective view of the drum cartridge, illustrating an attachment of a photosensitive drum to a drum frame.

First, the operator positions the photosensitive drum 21 above the transfer roller 23 such a right end portion of the friction member 58 of the photosensitive drum 21 is put above the recess portion 41 of the drum receiving portion 40, as depicted in FIGS. 5 and 6.

Then, the friction member 58 of the photosensitive drum 21 faces the friction pad 39 of the base frame 32. Thereafter, the operator attaches the cover frame 33 to a rear end portion of the base frame 32 from above. In this state, the drum shaft insertion openings 38 of the base frame 32, the drum shaft insertion openings 53 of the cover frame 33, and the tubular portions 66 of the flange members 55 are substantially matched with each other when viewed in the left-right direction.

Then, the operator inserts the drum shaft 56 into the drum shaft insertion openings 38 of the base frame 32, the drum shaft insertion openings 53 of the cover frame 33, the tubular portions 66 of the flange members 55, and the drum shaft insertion opening 67 of the friction member 58.

4. Details of Developing Cartridge (1) Structure of Developing Cartridge

Figure 7:
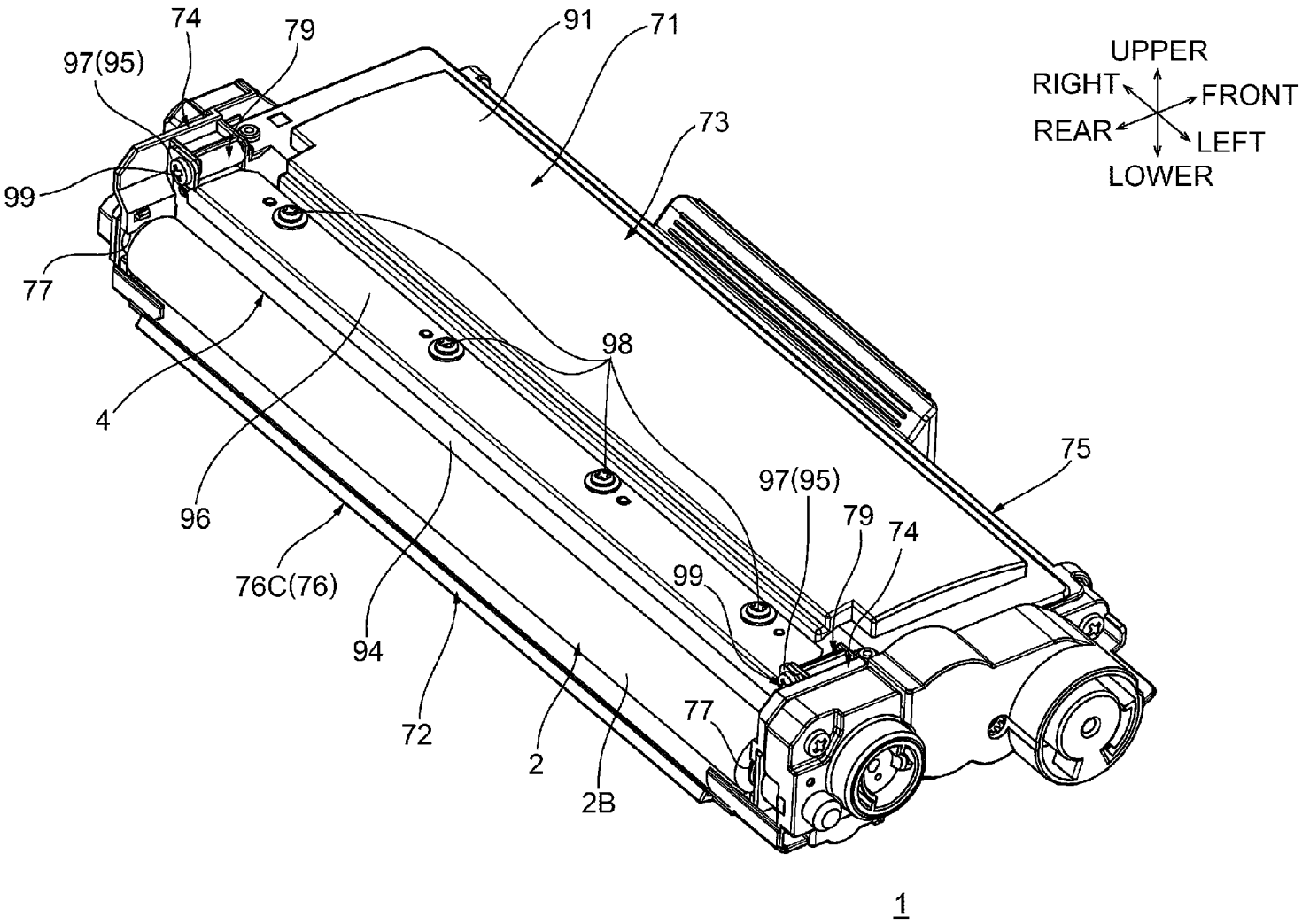
FIG. 7 is a perspective view of the developing cartridge depicted in FIG. 1 viewed from an upper rear side thereof.

As depicted in FIGS. 1 and 7, the developing cartridge 1 includes a casing e.g., a developing frame 71, the layer-thickness regulating blade 4, a blade seal 93, two side seals 90, and two shaft seals 89.

(1-1) Developing Frame

The developing frame 71 has a generally box shape. A rear end portion of the developing frame 71 is open. The developing frame 71 includes a base frame 72 and a cover frame 73.

Figure 8:
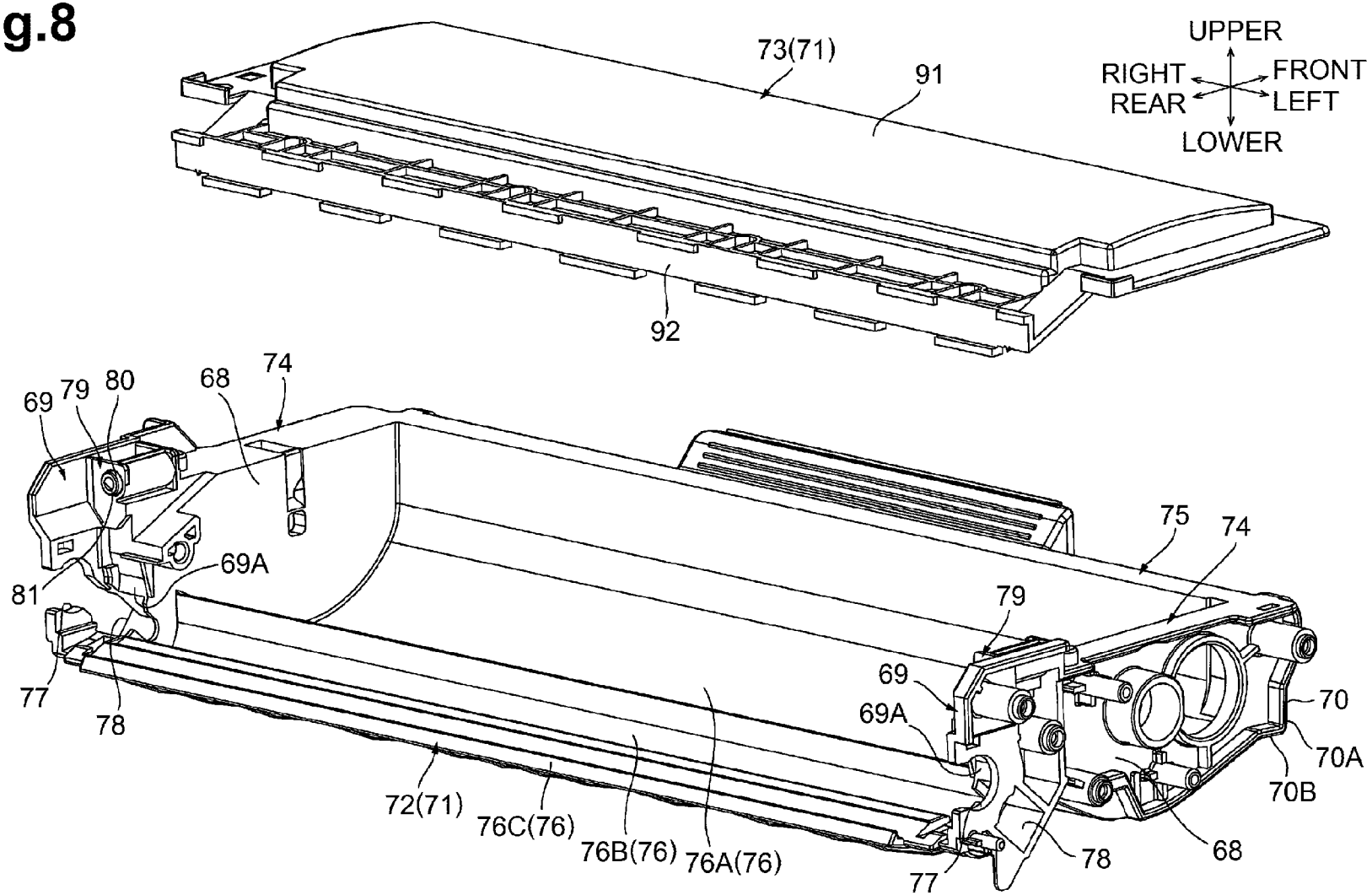
FIG. 8 is an exploded perspective view of a developing frame viewed from an upper rear side thereof.
Figure 13:
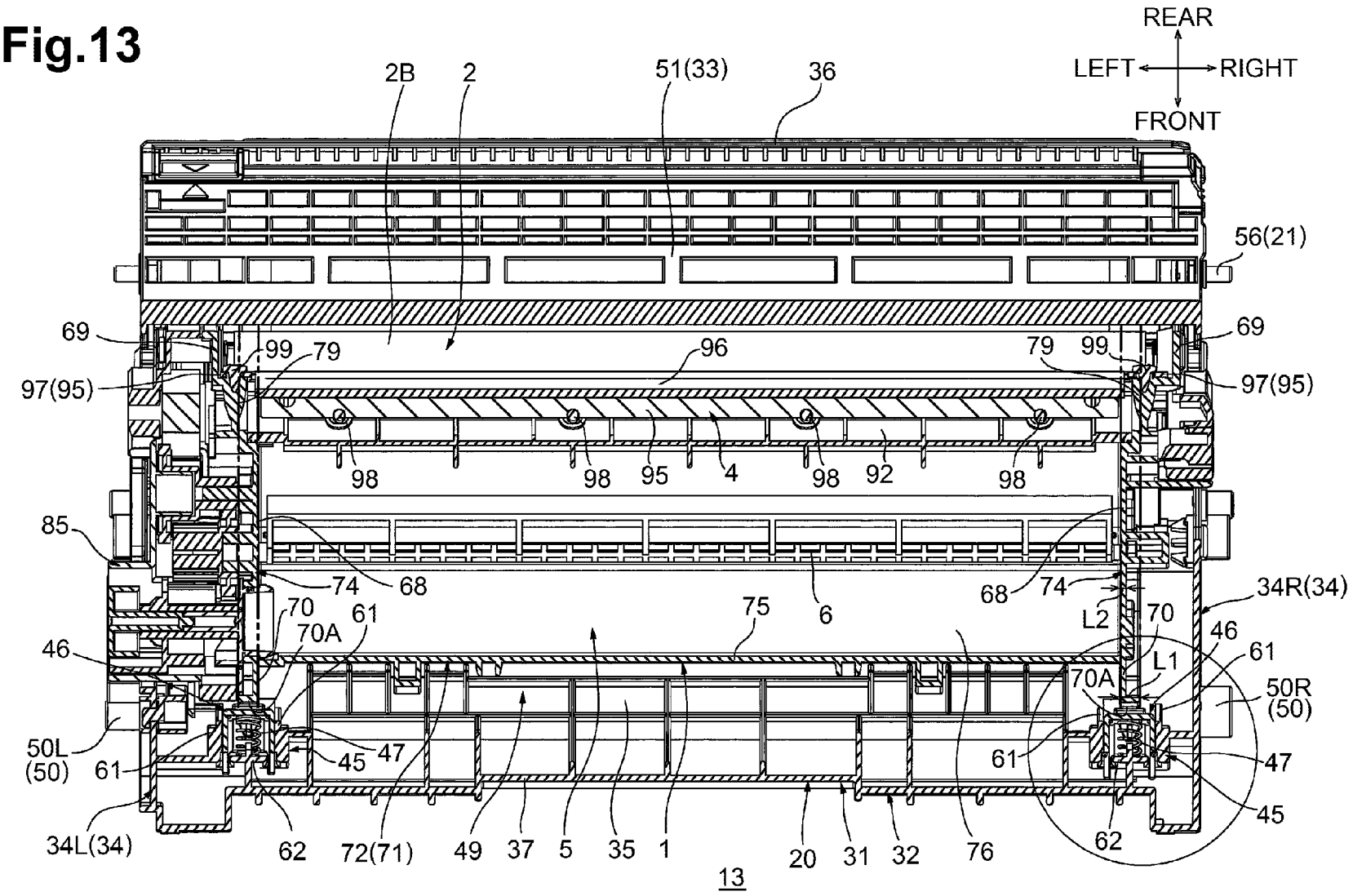
FIG. 13 is a sectional view of the process cartridge depicted in FIG. 10B, taken along a line C-C in FIG. 10B.

The base frame 72 has a bottomed frame shape, as depicted in FIGS. 8 and 13. The base frame 72 is integrally provided with a pair of side walls 74, a front wall 75, and a bottom wall 76.

Each side wall 74 is disposed at each end portion of the base frame 72 in the left-right direction. Each side wall 74 includes a wall portion, e.g., a body 68, a projecting portion 69, an attachment portion, a blade attachment portion 79, and an extended portion 70.

The body 68 is disposed at a central portion of the side wall 74. The body 68 has a generally rectangular flat plate shape in side view. The body 68 extends along the front-rear direction.

The projecting portion 69 is disposed at a rear end portion of the side wall 74. The projecting portion 69 extends outward in the left-right direction continuously from an outward end portion of a rear end portion of the body 68 in the left-right direction, and extends rearward. The projecting portion 69 has a generally rectangular shape in side view. The projecting portion 69 includes a developing roller shaft insertion opening 77 and a supply roller shaft insertion opening 78.

The developing roller shaft insertion opening 77 is disposed at a rear end portion of the projecting portion 69. The developing roller shaft insertion opening 77 has a generally circular shape in side view with a rear end portion thereof open. The developing roller shaft insertion opening 77 extends through the projecting portion 69 in the left-right direction. The inside diameter of the developing roller shaft insertion opening 77 is greater than the diameter of the developing roller shaft 2A of the developing roller 2.

The supply roller shaft insertion opening 78 is disposed in front of and below the developing roller shaft insertion opening 77. The supply roller shaft insertion opening 78 has a generally rectangular shape in side view. The inside dimension of the supply roller shaft insertion opening 78 is greater than the diameter of the supply roller shaft 3A of the supply roller 3.

The blade attachment portion 79 is disposed at an upper end portion of the side wall 74. The blade attachment portion 79 protrudes upward continuously from an upper rear end portion of the body 68. The blade attachment portion 79 has a generally prism shape. The blade attachment portion 79 extends along the front-rear direction. The rear surface of the blade attachment portion 79 continues to the rear surface of the body 68, and extends along the top-bottom direction. The blade attachment portion 79 includes a screw hole 81 and a boss 80.

The screw hole 81 is disposed at an upper portion of the blade attachment portion 79 in the top-bottom direction. The screw hole 81 is recessed forwardly from the rear surface of the blade attachment portion 79. The screw hole 81 has a generally circular shape in front view.

The boss 80 protrudes rearward from the peripheral edge of the screw hole 81. The boss 80 has a generally tubular shape.

Figure 9:
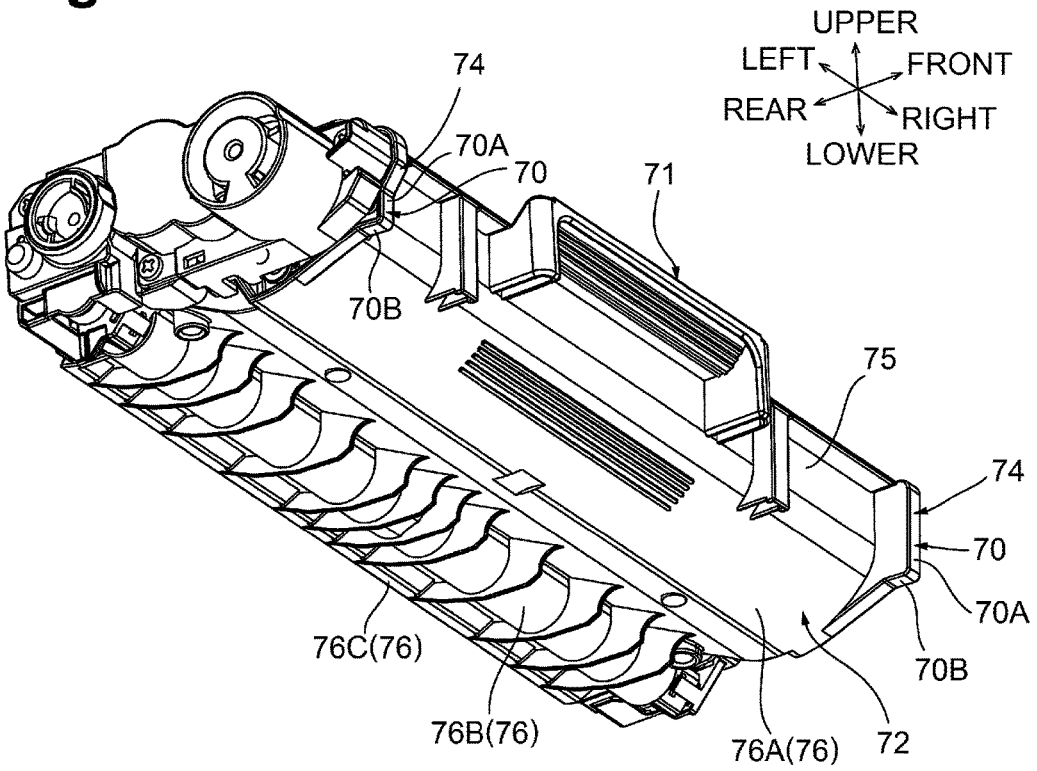
FIG. 9 is a perspective view of the developing cartridge depicted in FIG. 7 viewed from a lower front side thereof.
Figure 11:
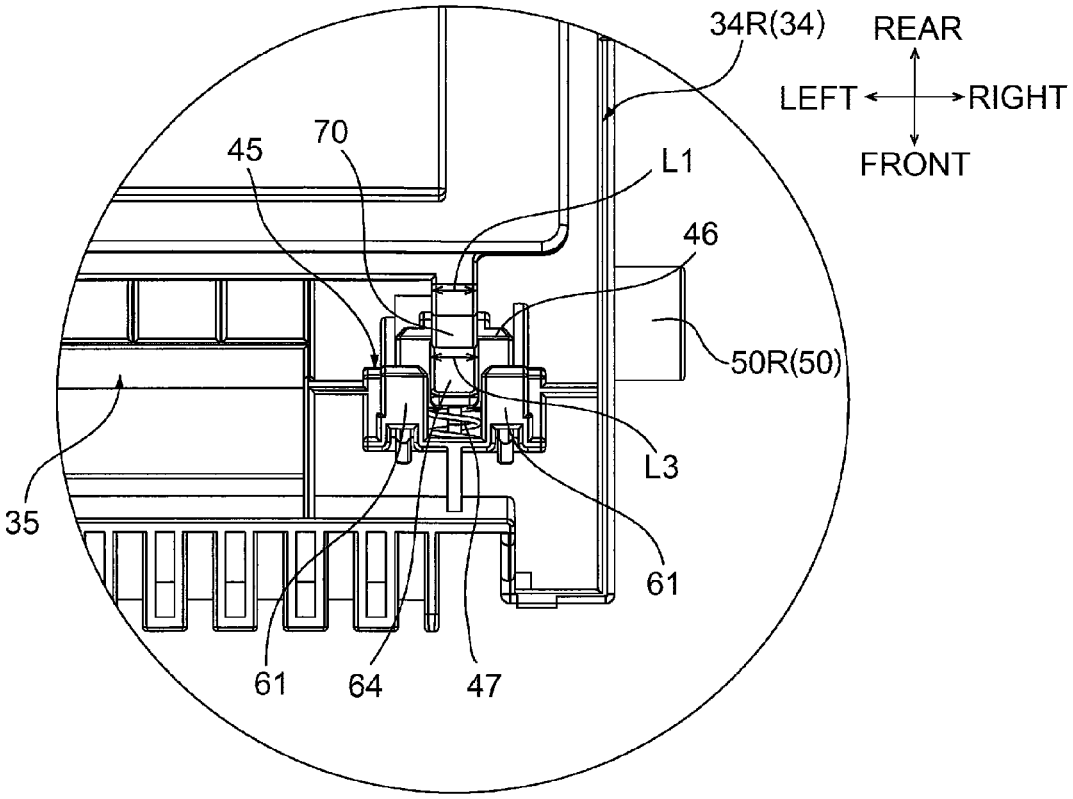
FIG. 11 is a partially enlarged view of the process cartridge depicted in FIG. 10A.
Figure 14:
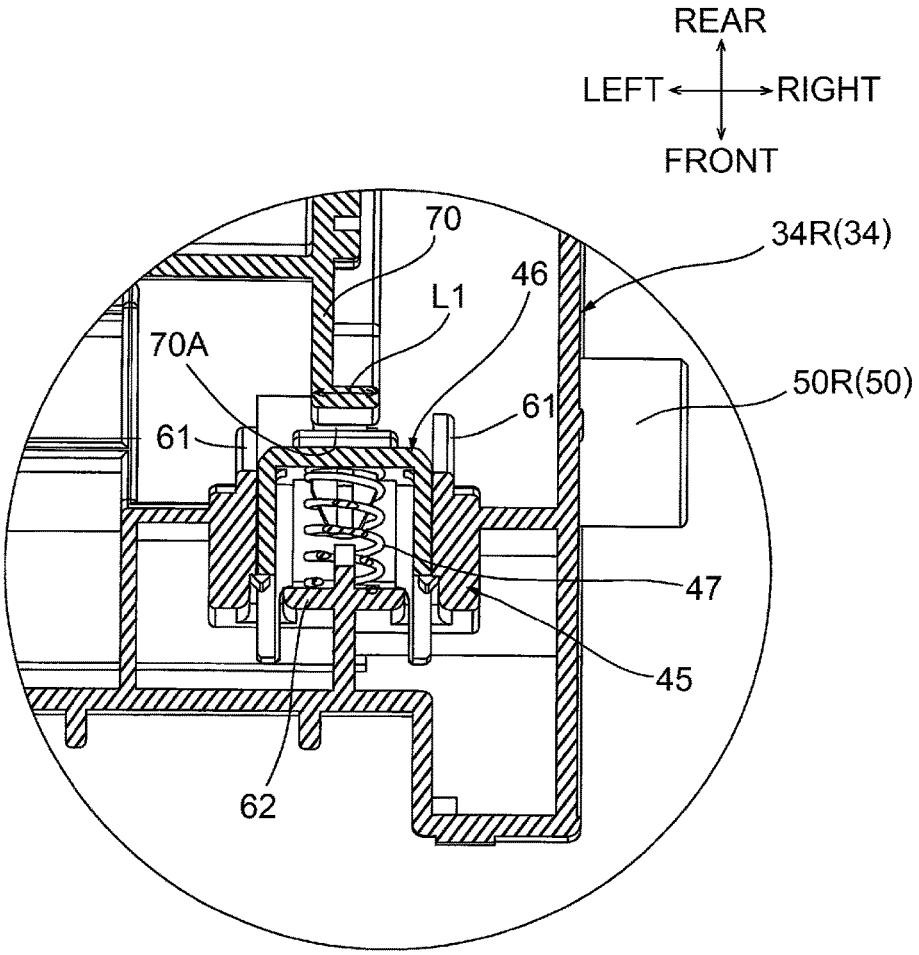
FIG. 14 is a partially enlarged sectional view of the process cartridge depicted in FIG. 13.

As depicted in FIG. 9, the extended portion 70 is disposed at a front end portion of the side wall 74. The extended portion 70 has a generally rectangular flat plate shape in side view. The extended portion 70 extends forward continuously from a front end portion of the body 68. A front surface 70A of a lower end portion of the extended portion 70 is an example of a receiving portion. A lower surface 70B of the extended portion 70 is an example of a contact portion. As depicted in FIGS. 13 and 14, a dimension L1 of the extended portion 70 in the left-right direction is longer than a thickness L2 of a portion of the body 68, for example, in front of an agitator shaft. As depicted in FIG. 11, the dimension L1 of the extended portion 70 is approximately the same as a dimension L3 of the protruding portion 64 of the pressing member 46 of the drum frame 31 in the left-right direction. As depicted in FIG. 13, the body 68 is positioned between the extended portion 70 and the blade attachment portion 79. As indicated by an imaginary line in FIG. 13, the extended portion 70 overlaps, when viewed in the front-rear direction, with the blade attachment portion 79 and an end portion of the developing roller body 2B in the left-right direction.

As depicted in FIGS. 1 and 9, the bottom wall 76 is integrally provided with a first portion 76A, a second portion 76B, and a third portion 76C.

The first portion 76A is disposed at a front half portion of the base frame 72. The first portion 76A has a generally arc shape in sectional view. A generally central portion of the first portion 76A in the front-rear direction is depressed downward. Each left and right end portion of the first portion 76A continues to a lower end portion of the body 68 of the relevant side wall 74. The first portion 76A constitutes the bottom wall of the toner chamber 5.

The second portion 76B is disposed behind the first portion 76A. The second portion 76B has a generally arc shape in sectional view. The second portion 76B continues to a rear end portion of the first portion 76A and extends rearward while curving, along an outer peripheral surface of the supply roller 3. Each left and right end portion of the second portion 76B continues to a lower end portion of the body 68 of the relevant side wall 74.

The third portion 76C is disposed behind the second portion 76B. The third portion 76C has a generally linear shape in sectional view. The third portion 76C continues to a rear end portion of the second portion 76B and extends rearward. Each left and right end portion of the third portion 76C continues to a lower end portion of the projecting portion 69 of the relevant side wall 74.

The front wall 75 continues to a front end portion of the bottom wall 76 and extends upward. The front wall 75 has a generally rectangular shape in front view. Each left and right end portion of the front wall 75 continues to a front end portion of the body 68 of the relevant side wall 74.

As depicted in FIGS. 1 and 8, the cover frame 73 is disposed above the base frame 72. The cover frame 73 is integrally provided with a cover portion 91 and a blade seal supporting portion 92.

The cover portion 91 has a generally rectangular flat plate shape in plan view. A front end portion of the cover portion 91 is welded to an upper end portion of the front wall 75 of the base frame 72. Each left and right end portion of the cover portion 91 is welded to an upper end portion of the relevant side wall 74 of the base frame 72.

The blade seal supporting portion 92 is disposed behind the cover portion 91 between rear end portions of the side walls 74 of the base frame 72. The blade seal supporting portion 92 has a generally rectangular flat plate shape in plan view. The blade seal supporting portion 92 continues from a rear end portion of the cover portion 91 and extends rearward. Each left and right end portion of the blade seal supporting portion 92 is welded to the relevant side walls 74 of the base frame 72.

(1-2) Layer-Thickness Regulating Blade and Blade Seal

As depicted in FIGS. 1 and 7, the layer-thickness regulating blade 4 includes a first holding member 95, a second holding member 96, and a blade member 94.

The first holding member 95 is disposed above the blade seal supporting portion 92 of the cover frame 73. The first holding member 95 has a generally L-shaped bent plate shape elongated in the left-right direction in sectional view. More specifically, a front portion of the first holding member 95 extends along the front-rear direction and a rear portion of the first holding member 95 extends downward. The front end portion of the first holding member 95 faces an upper end portion of the blade seal supporting portion 92. The first holding member 95 includes two fixing portions 97.

Each fixing portion 97 protrudes upward from each end portion of the first holding member 95 in the left-right direction. Each fixing portion 97 has a generally rectangular flat plate shape in front view. Each fixing portion 97 includes a through hole (not depicted) in which the boss 80 of the base frame 72 fits. Each fixing portion 97 is fixed to the rear face of the blade attachment portion 79 of the base frame 72 with a screw 99 screwed into the screw hole 81 of the base frame 72.

The second holding member 96 is disposed above the first holding member 95. The second holding member 96 has a generally L-shaped bent plate shape elongated in the left-right direction in sectional view. More specifically, a front portion of the second holding member 96 extends along the front-rear direction above the front portion of the first holding member 95. A rear portion of the second holding member 96 extends downward to face an upper end portion of the blade member 94 behind the blade member 94. The second holding member 96 is fixed to the first holding member 95 with screws 98.

The blade member 94 has a generally rectangular flat plate shape elongated in the left-right direction in front view. The blade member 94 extends along the top-bottom direction. An upper end portion of the blade member 94 is held between the rear portion of the first holding member 95 and the rear portion of the second holding member 96. A lower end portion of the blade member 94 contacts a front end portion of the developing roller 2.

As depicted in FIG. 1, the blade seal 93 is disposed between the blade member 94 of the layer-thickness regulating blade 4 and the rear face of the blade seal supporting portion 92 of the cover frame 73. The blade seal 93 has a generally prism shape. The blade seal 93 extends along the left-right direction. The blade seal 93 includes a resin sponge. The blade seal 93 seals a portion between the blade member 94 and the blade seal supporting portion 92.

(1-3) Side Seals and Shaft Seals

As depicted in FIG. 12C, each side seal 90 is disposed between an inward rear surface 69A of the projecting portion 69 of the relevant side wall 74 and each end portion of the developing roller body 2B in the left-right direction. More specifically, each side seal 90 overlaps with the respective right and left extended portion 70 when viewed in the front-rear direction. Each side seal 90 includes a resin sponge including, for example, urethane resin. Each side seal 90 has a generally flat plate shape. Each side seal 90 contacts an outer peripheral surface of the developing roller body 2B while curving. Each side seal 90 is compressed between the outer peripheral surface of the developing roller body 2B and the inward rear surface 69A of the projecting portion 69.

Each shaft seal 89 is disposed around the supply roller shaft 3A in the supply roller shaft insertion opening 78 of the respective side wall 74. Each shaft seal 89 extends along the left-right direction, and has a generally prism shape. Each shaft seal 89 includes an elastic member, e.g., a sponge. Each shaft seal 89 is compressed between an inner surface of the supply roller shaft insertion opening 78 and the supply roller shaft 3A.

(2) Operations of Mounting Developing Cartridge to Drum Cartridge

To mount the developing cartridge 1 to the drum cartridge 20, an operator inserts a rear end portion of the developing cartridge 1 to the developing cartridge mount portion 49 of the drum cartridge 20 from above.

The extended portions 70 of the developing cartridge 1 contact the rear faces 64A of the protruding portions 64 of the pressing members 46 of the drum cartridge 20, as depicted in FIG. 12A.

Then, the operator presses a front end portion of the developing cartridge 1 rearward and downward.

Accordingly, the developing cartridge 1 moves rearward and downward while the extended portions 70 slide along the rear faces 64A of the protruding portions 64 of the pressing members 46.

As the developing roller 2 contacts the photosensitive drum 21 from its front as depicted in FIG. 12B, the further movement of a rear portion of the developing cartridge 1 in a rearward and downward direction is restricted.

Then, the operator presses down a front end portion of the developing cartridge 1.

Accordingly, the developing cartridge 1 rotates clockwise in left side view with a rear end portion of the developing cartridge 1 as a pivot. At this time, the extended portions 70 of the developing cartridge 1 move down while pressing the rear faces 63A of the pressing portions 63 of the pressing members 46 forwardly.

Accordingly, the pressing members 46 are moved forward against the urging force of the compression springs 47. The extended portions 70 move down along the rear faces 63A of the pressing portions 63 of the pressing members 46 and are positioned behind the pressing members 46.

As lower end portions of the extended portions 70 contact the contact protrusions 48 of the drum frame 31 from above, further rotation of the developing cartridge 1 is restricted.

At this time, the front surfaces 70A of lower end portions of the extended portions 70, as depicted in FIGS. 12C and 14, contact the rear ends E2 of the pressing portions 63 of the pressing members 46.

Accordingly, the pressing members 46 press the front surfaces 70A of lower end portions of the extended portions 70 rearward, with the urging force of the compression springs 47. Thus, the developing roller 2 is pressed against the photosensitive drum 21 by the pressing force of the pressing members 46.

Thus, mounting of the developing cartridge 1 to the drum cartridge 20 completes.

5. Effects (1) In the developing cartridge 1, the blade attachment portions 79 to which the layer-thickness regulating blade 4 is attached, and the extended portions 70 configured to be pressed against the pressing member 46 overlap in a pressing direction of the developing roller 2 toward the photosensitive drum 21, e.g., the front-rear direction, as depicted in FIG. 13.

Therefore, the pressing force received by the extended portions 70 may reliably act on the blade attachment portions 79, so that the layer-thickness regulating blade 4 may contact the developing roller 2 stably.

Consequently, warp or distortion of the layer-thickness regulating blade 4 may be reduced.

(2) In the developing cartridge 1, the layer-thickness regulating blade 4 is attached to the developing frame 71 at each left and right end portion of the blade 4, as depicted in FIG. 7.

Therefore, the layer-thickness regulating blade 4 may stably contact the developing roller 2 in the left-right direction.

Consequently, warp or distortion of the layer-thickness regulating blade 4 may further be reduced.

(3) In the developing cartridge 1, as depicted in FIGS. 13 and 14, the dimension L1 of the extended portion 70 in the left-right direction is longer than the thickness L2 of a portion of the body 68 of the side wall 34, for example, in front of an agitator shaft.

Therefore, the extended portions 70 may stably receive the pressing force from the pressing members 46.

(4) In the developing cartridge 1, the developing frame 71 includes the extended portions 70 extending rearward, as depicted in FIG. 9.

Therefore, the front surfaces 70A of lower end portions of the extended portions 70 may be readily pressed by the pressing members 46 in a front to rear direction.

(5) In the developing cartridge 1 and the drum cartridge 20, when the developing cartridge 1 is mounted to the drum cartridge 20, the lower surfaces 70B of the extended portions 70 contact the contact protrusions 48 of the drum frame 31 from above, as depicted in FIG. 12C.

Accordingly, the extended portions 70 may be positioned with respect to the top-bottom direction in the drum frame 31.

Therefore, the front surfaces 70A of lower end portions of the extended portions 70 may be brought into reliable contact with the rear ends E2 of the pressing members 46.

Consequently, the extended portions 70 may receive the pressing force from the pressing members 46 more stably.

(6) In the developing cartridge 1, as depicted in FIG. 9, the lower surfaces 70B of the extended portions 70 continue to the front surfaces 70A of lower end portions of the extended portions 70.

Therefore, pressing of the developing roller 2 toward the photosensitive drum 21 and the positioning of the extended portions 70 with respect to the drum frame 31 may be achieved with a simple structure.

(7) In the drum cartridge 20, as depicted in FIG. 13, the pressing members 46 press the front surfaces 70A of lower end portions of the extended portions 70 of the developing cartridge 1. The pressing force may reliably act on the blade attachment portions 79 of the developing cartridge 1.

Consequently, the layer-thickness regulating blade 4 may stably contact the developing roller 2, and warp or distortion of the layer-thickness regulating blade 4 may be reduced.

(8) In the drum cartridge 20, as depicted in FIG. 3, the rear face 64A of the protruding portion 64 of the pressing member 46 inclines more rearward as the rear face 64A of extends more downward.

Therefore, the developing cartridge 1 may be guided rearward using the rear faces 64A of the protruding portions 64.

Consequently, the developing cartridge 1 may be positioned smoothly behind the pressing members 46.

(9) In the drum cartridge 20, as depicted in FIG. 12C, the distance D1 between the upper end E1 of the protruding portion 64 and the rear end E2 of the pressing portion 63 is shorter than the distance D2 between the rear end E2 of the pressing portion 63 and the front end E3 of the pressing portion 63.

When the developing cartridge 1 is mounted to the drum frame 31, the developing cartridge 1 presses the rear face 64A of the protruding portion 64 forwardly.

At this time, the distance D2 between the rear end E2 of the pressing portion 63 and the front end E3 of the pressing portion 63, e.g., the dimension of the pressing member 46 in the front-rear direction, is relatively long. When the pressing members 46 slide, rattle of the pressing members 46 in the top-bottom direction may be restricted.

Therefore, mounting of the developing cartridge 1 to the drum frame 31 may be guided more smoothly.

Consequently, the developing cartridge 1 may be mounted to the drum frame 31 more smoothly.

(10) In the drum cartridge 20, as depicted in FIG. 10A, the dimension L1 of the extended portion 70 in the left-right direction is approximately the same as the dimension L3 of the protruding portion 64 of the pressing member 46 of the drum frame 31 in the left-right direction.

Therefore, when the developing cartridge 1 is mounted to the drum frame 31, the front surfaces 70A of lower end portions of the extended portions 70 may reliably contact the protruding portions 64.

(11) In the drum cartridge 20, as depicted in FIG. 3, the pressing member 46 is supported by the pressing member supporting portion 45 between a pair of the side plates 61. A portion of the protruding portion 64 protrudes upward through a portion between upper end portions of the side plates 61.

Therefore, the pressing member 46 may be supported while a portion of the protruding portion 64 protrudes above the pressing member supporting portion 45.

(12) In the drum cartridge 20, the positioning bosses 50 overlap with the contact protrusions 48 when viewed from the left-right direction, as depicted in FIG. 12A.

Therefore, the developing cartridge 1 may be supported in a front end portion of the drum cartridge 20 configured to be positioned with respect to the main casing 12.

Therefore, the developing cartridge 1 may be supported in the drum frame 31 more stably.

(13) In the drum cartridge 20, the extended portions 70 overlap with end portions of the developing roller body 2B in the left-right direction, when viewed in the front-rear direction, as depicted in FIG. 13.

Therefore, each end portion of the developing roller body 2B in the left-right direction may be pressed against the photosensitive drum 21 more firmly, using the pressing force from the pressing members 46.

Consequently, the developing roller body 2B may be brought into reliable contact with the photosensitive drum 21 in the left-right direction.

(14) In the drum cartridge 20, as depicted in FIGS. 12C and 13, each side seal 90 overlaps with the respective left and right extended portion 70 when viewed in the front-rear direction.

Therefore, the side seals 90 may be compressed using the pressing force from the pressing members 46.

Consequently, portions between each end portion of the developing roller body 2B in the left-right direction and the respective projecting portions 69 of the developing frame 71 may be sealed more reliably.

6. Modification (1) In the above-described illustrative embodiment, the tubular portion 66 of the left flange member 55 contacts the inner surface of the left side wall 34L of the drum frame 31.

Figure 15:
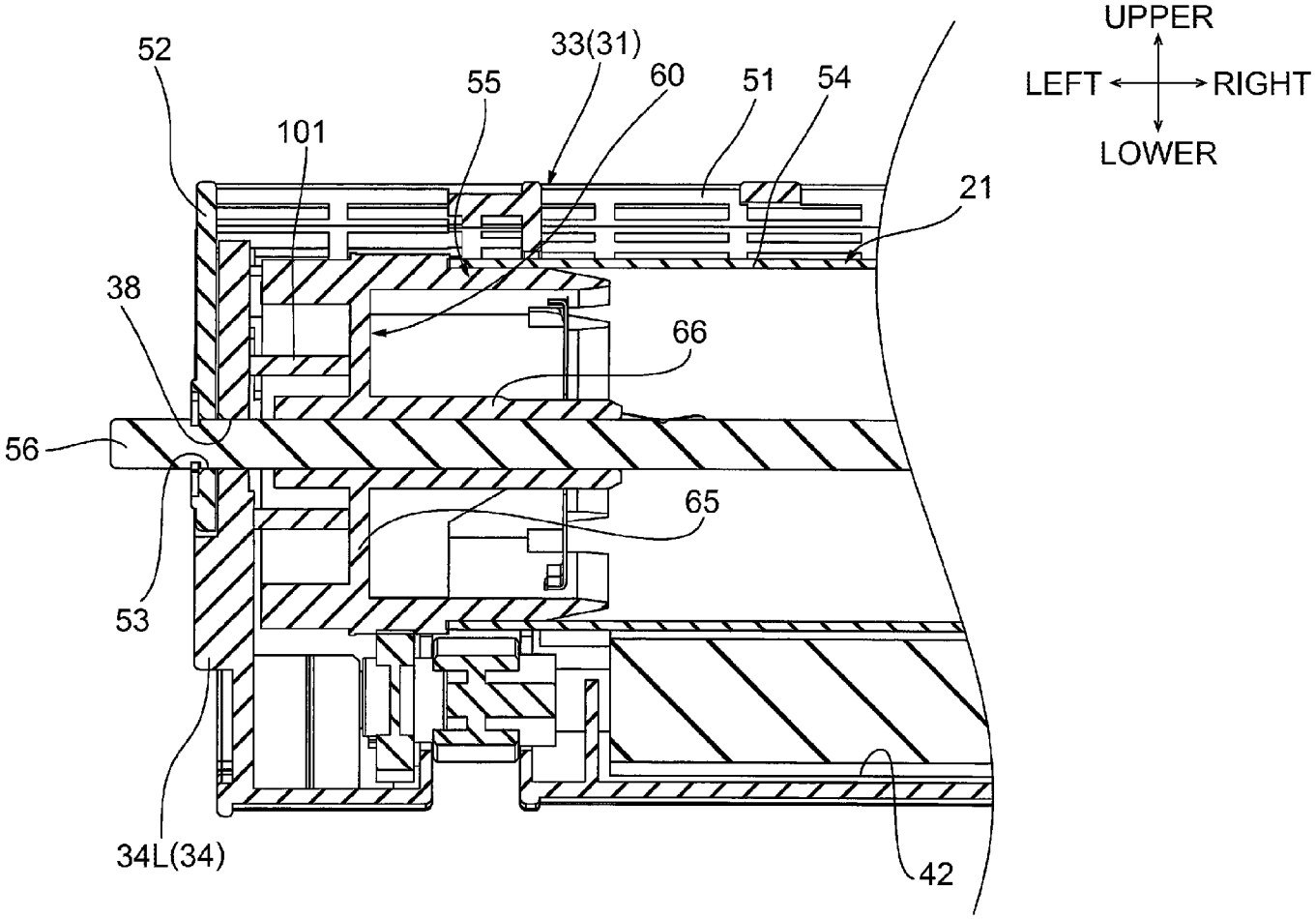
FIG. 15 is a sectional view of a modified drum cartridge in which a contact portion is provided for a flange member with a space between a tubular portion and the contact portion.

The shape of the left flange member 55 is not limited to a particular shape. For example, as depicted in FIG. 15, the photosensitive drum 21 may include a contact portion 101 that contacts the inner surface of the left side wall 34L of the drum frame 31. The contact portion 101 may be spaced outwardly in the radial direction of the tubular portion 66.

The contact portion 101 protrudes leftward from the left surface of the flat plate portion 65. The left end of the contact portion 101 is positioned leftward of the left end of the tubular portion 66 and contacts the inner surface of the left side wall 34L of the drum frame 31.

The contact portion 101 and the tubular portion 66 may be interconnected by, for example, a rib extending in the radial direction of the tubular portion 66.

Figure 16:
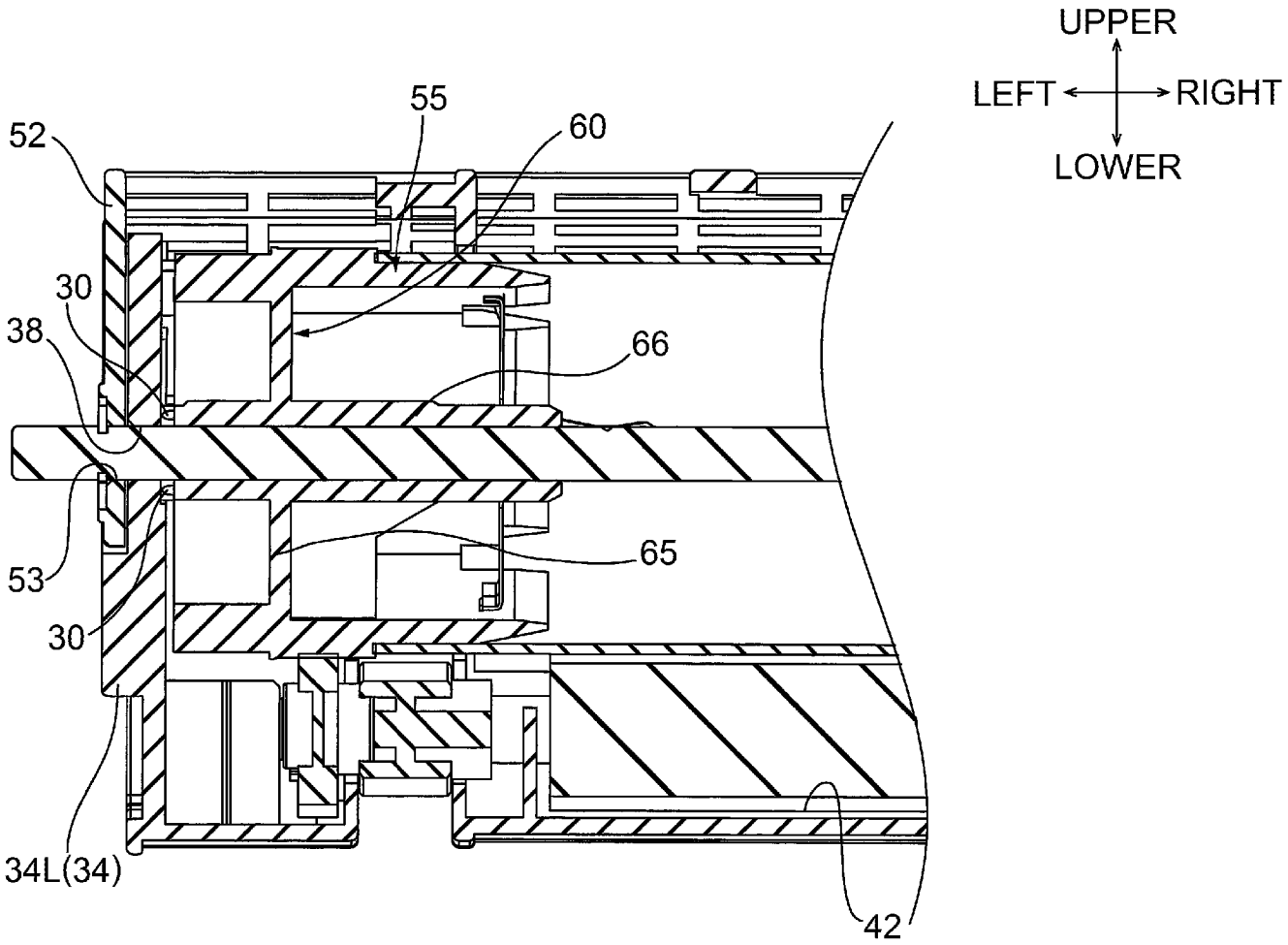
FIG. 16 is a sectional view of a modified drum cartridge in which projections are provided for the tubular portion of the flange member.

The tubular portion 66 of the left flange member 55 may include projections 30, as depicted in FIG. 16.

The projections 30 protrude leftward from the left end of the tubular portion 66 of the left flange member 55. The projection 30 has a generally semicircular shape in sectional view. The projections 30 contact the inner surface of the left side wall 34L of the drum frame 31.

(2) As the developing agent carrying member, for example, a developing sleeve, may be used instead of the developing roller 2.

(3) As the layer-thickness regulating member, for example, a rubber blade or a blade including a metal blade member and a rubber contact portion disposed at an end of the metal blade member, may be used instead of the layer-thickness regulating blade 4.

(4) The layer-thickness regulating blade 4 may be attached, for example, by bonding the fixing portions 97 to the respective blade attachment portions 79 with adhesive. Further, the blade attachment portion 79 may include a boss extending rearward. The layer-thickness regulating blade 4 may be attached by inserting the bosses into openings (not depicted) of the fixing portions 97 and then applying heat to the bosses while pressing the bosses forwardly to melt the bosses.

(5) In the above-described illustrative embodiment, the pressing members 46 of the drum cartridge 20 press the front surfaces 70A of lower end portions of the extended portions 70 of the developing cartridge 1.

However, the drum cartridge 20 might not have to include the pressing members 46.

In this case, the developing cartridge 1 may include a compression spring. An end portion of the compression spring may be connected to the front surface 70A of a lower end portion of the extended portion 70. The other end of the compression spring may contact the front wall 37 of the drum cartridge 20 with the developing cartridge 1 mounted to the drum cartridge 20.

What is claimed is:

1. A developing cartridge configured to be non-destructively detachable from an image carrying member cartridge comprising:

a casing configured to store a developing agent, the casing of the developing cartridge being configured to be non-destructively detachable from a casing of the image carrying member cartridge;

a developing agent carrying member disposed rotatably in the casing and configured to carry the developing agent in the casing; and a layer-thickness regulating member disposed in the casing and configured to regulate a thickness of a layer of the developing agent carried on the developing agent carrying member;

wherein the casing comprises:

an attachment surface to which the layer-thickness regulating member is directly attached, the layer-thickness regulating member remaining attached to the attachment surface of the developing cartridge when the developing cartridge is non-destructively detached from the image carrying member cartridge; and a side wall, integrally formed with the attachment surface, having a rib which protrudes directly from the side wall outwardly in an axial direction of the developing agent carrying member, the rib having a first surface and a second surface perpendicular to the first surface, the first and second surfaces of the rib extending outwardly in the axial direction from the side wall, the side wall extending between the first surface and the attachment surface in a direction perpendicular to the axial direction of the developing agent carrying member, and wherein the first surface, the second surface, the attachment surface and the side wall are aligned such that an imaginary straight line, parallel to the direction perpendicular to the axial direction, overlaps the first, second and attachment surfaces when viewed from above.

2. The developing cartridge according to claim 1, wherein the casing comprises the attachment surface disposed at each end portion thereof in the axial direction.

3. The developing cartridge according to claim 1, wherein the casing comprises an extended portion in the direction perpendicular to the axial direction, and wherein the extended portion extends upstream in the direction perpendicular to the axial direction.

4. The developing cartridge according to claim 3, wherein the extended portion comprises a contact portion configured to contact a frame supporting an image carrying member.

5. The developing cartridge according to claim 1, wherein the side wall and the attachment surface are formed integrally.

6. A process cartridge comprising:

a developing cartridge comprising:

a casing configured to store a developing agent;

a developing agent carrying member disposed rotatably in the casing and configured to carry the developing agent in the casing; and a layer-thickness regulating member disposed in the casing and configured to regulate a thickness of a layer of the developing agent carried on the developing agent carrying member, wherein:

the casing comprises:

an attachment surface to which the layer-thickness regulating member is directly attached;

a receiving surface configured to receive a pressing force, with which a pressing member presses the developing agent carrying member toward an image carrying member in a predetermined direction perpendicular to an axial direction of the developing agent carrying member; and a wall extending between the receiving surface and the attachment surface along the predetermined direction in which the pressing member presses the developing agent carrying member toward the image carrying member, the wall overlapping the developing agent carrying member in the axial direction; and the receiving surface overlaps with at least a portion of the attachment surface when viewed in the predetermined direction; and an image carrying member cartridge from which the developing cartridge is configured to be attachable and detachable, the image carrying member cartridge comprising:

an image carrying member configured to carry a developing agent image;

a frame configured to support the image carrying member and to receive the developing cartridge; and the pressing member configured to be slidably supported in the predetermined direction by the frame and to directly contact and press the receiving surface of the developing cartridge casing in the predetermined direction, wherein the pressing member, the receiving surface, the attachment surface and the wall are aligned in the predetermined direction such that an imaginary straight line, parallel to the predetermined direction, overlaps the receiving surface, the attachment surface and the wall when viewed from above.

7. The process cartridge according to claim 6, wherein:

the pressing member comprises a protruding portion protruding toward an upstream side in a mounting direction in which the developing cartridge is mounted to the frame, and the protruding portion comprises an inclined surface that inclines more downstream in the predetermined direction that the developing agent carrying member is pressed toward the image carrying member as the inclined surface extends more downstream in the mounting direction.

8. The process cartridge according to claim 7, wherein a distance between a contact point of the pressing member with the receiving surface and an upstream end of the pressing member in the predetermined direction is longer than a distance between the contact point and an upstream end of the protruding portion in the mounting direction.

9. The process cartridge according to claim 7, wherein a length of the protruding portion in the axial direction is equal to or greater than a length of the receiving surface in the axial direction.

10. The process cartridge according to claim 7, wherein the frame comprises a pressing member supporting portion configured to support the pressing member at each side of the protruding portion in the axial direction.

11. The process cartridge according to claim 6, wherein the developing cartridge comprises a contact portion configured to contact the frame, and wherein the frame comprises a second contact portion configured to contact the contact portion.

12. The process cartridge according to claim 11, wherein:

the frame comprises a positioning portion configured to be positioned with respect to a body of an image forming apparatus, and the positioning portion overlaps with the second contact portion when viewed from the axial direction.

13. A process cartridge comprising:

a developing cartridge comprising:

a casing configured to store a developing agent; and a developing agent carrying member disposed rotatably in the casing and configured to carry the developing agent in the casing; and an image carrying member cartridge comprising:

an image carrying member configured to carry a developing agent image;

a frame configured to support the image carrying member and to receive the developing cartridge; and a pressing member configured to be slidably supported in a predetermined direction perpendicular to an axial direction of the developing agent carrying member by the frame and to directly contact and press a receiving surface of the casing of the developing cartridge in the predetermined direction, the predetermined direction being perpendicular to the axial direction, wherein:

the casing comprises:

an attachment surface to which a layer-thickness regulating member is directly attached;

the receiving surface configured to receive a pressing force for pressing the developing agent carrying member toward an image carrying member in the predetermined direction; and a wall extending between the receiving surface and the attachment surface along the predetermined direction in which the pressing member presses the developing agent carrying member toward the image carrying member, the wall overlapping the developing agent carrying member in the axial direction, and the receiving surface overlaps with at least a portion of the wall when viewed in the predetermined direction, and wherein the pressing member, the receiving surface, the attachment surface and the wall are aligned in the predetermined direction such that an imaginary straight line, parallel to the predetermined direction, overlaps the receiving surface, the attachment surface and the wall when viewed from above.

14. The process cartridge according to claim 13, wherein the pressing member is configured to entirely slide in the predetermined direction relative to the frame, and wherein the pressing member is connected to an elastic member.

15. The process cartridge according to claim 13, wherein the receiving surface is configured to directly contact the pressing member.

16. The process cartridge according to claim 13, wherein the pressing member, the receiving surface, the wall and the image carrying member are disposed in this order in the predetermined direction when the developing cartridge is attached to the image carrying member cartridge.

17. The process cartridge according to claim 13, wherein the developing cartridge is attachable to and detachable from the image carrying member cartridge.

* * * * *